US010711494B2

(12) United States Patent
Bingle et al.

(10) Patent No.: US 10,711,494 B2
(45) Date of Patent: Jul. 14, 2020

(54) HANDLE ASSEMBLY FOR A MOTOR VEHICLE DOOR

(71) Applicant: ADAC PLASTICS, INC., Grand Rapids, MI (US)

(72) Inventors: Robert Bingle, Grand Rapids, MI (US); Jerry Cummins, Grand Rapids, MI (US)

(73) Assignee: ADAC Plastics, Inc., Grand Rapids, MI (US)

( * ) Notice: Subject to any disclaimer, the term of this patent is extended or adjusted under 35 U.S.C. 154(b) by 235 days.

(21) Appl. No.: 14/908,350

(22) PCT Filed: Mar. 26, 2015

(86) PCT No.: PCT/US2015/022711
§ 371 (c)(1),
(2) Date: Jan. 28, 2016

(87) PCT Pub. No.: WO2015/148788
PCT Pub. Date: Oct. 1, 2015

(65) Prior Publication Data

US 2016/0208523 A1 Jul. 21, 2016

Related U.S. Application Data

(60) Provisional application No. 61/970,715, filed on Mar. 26, 2014.

(51) Int. Cl.
*E05B 85/10* (2014.01)
*E05B 81/06* (2014.01)
(Continued)

(52) U.S. Cl.
CPC ..... *E05B 85/10* (2013.01); *E05B 81/06* (2013.01); *E05B 85/103* (2013.01); *E05B 85/16* (2013.01);
(Continued)

(58) Field of Classification Search
CPC ..... E05B 85/16; E05B 17/10; E05B 17/22; E05B 41/00; E05B 85/10; E05B 81/06; E05B 85/103; Y10T 292/57
(Continued)

(56) References Cited

U.S. PATENT DOCUMENTS 2,657,085 A * 10/1953 Dedoes ..... E05C 1/12 292/169
2,749,167 A * 6/1956 Love ..... E05C 3/122 16/302
(Continued)

OTHER PUBLICATIONS

WIPO, "International Preliminary Report on Patentability" for PCT/US2015/022711, dated Oct. 6, 2016.

*Primary Examiner* — Kristina R Fulton
*Assistant Examiner* — Faria F Ahmad
(74) *Attorney, Agent, or Firm* — Barnes & Thornburg LLP

(57) ABSTRACT

A handle assembly for a vehicle door includes: a body defining an opening dimensioned to at least partially receive therein a hand of a user, the opening communicating with a chamber defined in the body anterior of the opening; at least one pivot arm mounted on the body for pivotal movement relative thereto; a closure for the opening, the closure connected to the at least one pivot arm for pivotal movement relative thereto, and the closure selectively moveable relative to the body between a first position, in which the closure occupies the opening, and a second position, in which the closure is moved into the chamber so that the hand of the user may be at least partially received through the opening; and a motor for effecting selective movement of the closure between the first and second positions thereof. In movement from the first position to the second position of the closure, the at least one pivot arm pivotally moves relative to the body in a first direction and the closure pivotally moves
(Continued)

relative to the at least one pivot arm in a second direction which is opposite the first direction.

6 Claims, 21 Drawing Sheets

(51) Int. Cl.

| | |
|---|---|
| ***E05B 85/16*** | (2014.01) |
| ***E05B 17/10*** | (2006.01) |
| ***E05B 81/14*** | (2014.01) |
| ***E05B 81/08*** | (2014.01) |
| ***E05B 41/00*** | (2006.01) |
| ***E05B 5/00*** | (2006.01) |
| ***E05B 17/22*** | (2006.01) |

(52) U.S. Cl.
CPC ..... *E05B 5/006* (2013.01); *E05B 17/10* (2013.01); *E05B 17/22* (2013.01); *E05B 41/00* (2013.01); *E05B 81/08* (2013.01); *E05B 81/14* (2013.01); *Y10T 292/57* (2015.04)

(58) Field of Classification Search
USPC ..... 292/336.3
See application file for complete search history.

(56) References Cited

U.S. PATENT DOCUMENTS 3,936,082 A * 2/1976 Swanson ..... E05C 19/14 292/113
4,588,219 A * 5/1986 Kobayashi ..... E05B 85/18 292/336.3
5,560,659 A * 10/1996 Dault ..... E05B 13/005 292/336.3
6,062,614 A * 5/2000 Petzold ..... E05B 85/14 292/336.3
6,072,403 A * 6/2000 Iwasaki ..... G07C 9/00309 180/287
6,152,501 A * 11/2000 Magi ..... E05B 5/00 292/169
6,416,092 B1 * 7/2002 Rathmann ..... E05B 81/14 200/50.1
6,429,782 B2 * 8/2002 Pavatich ..... E05B 81/78 340/686.6
6,923,481 B2 * 8/2005 Bruderick ..... E05B 81/76 16/361
7,102,486 B2 * 9/2006 Yamagishi ..... G07C 9/00166 283/68
7,108,301 B2 * 9/2006 Louvel ..... E05B 81/78 292/201
7,665,776 B2 2/2010 Lang
7,819,442 B2 * 10/2010 Ieda ..... B60R 25/24 292/336.3
8,109,545 B2 * 2/2012 Lukas ..... E05B 13/002 292/336.3
8,943,752 B2 * 2/2015 Thomas ..... E05B 85/10 49/394
9,050,943 B2 * 6/2015 Muller ..... B60R 25/246
9,518,410 B2 * 12/2016 Vasi ..... E05B 5/006
9,624,698 B2 * 4/2017 Kindig ..... E05B 85/103
9,957,737 B2 * 5/2018 Patel ..... E05B 81/76
10,072,447 B2 * 9/2018 Fujiwara ..... E05B 81/06
2001/0011836 A1 * 8/2001 Grey ..... B60N 2/002 296/214
2001/0035656 A1 11/2001 Stuart et al.
2001/0052839 A1 * 12/2001 Nahata ..... E05B 81/78 340/5.72
2004/0177478 A1 * 9/2004 Louvel ..... E05B 81/78 16/430
2004/0232710 A1 * 11/2004 Jooss ..... E05B 81/78 292/336.3
2007/0069531 A1 * 3/2007 Herbert ..... E05B 85/107 292/336.3
2008/0163555 A1 * 7/2008 Thomas ..... E05B 85/10 49/460
2009/0039671 A1 * 2/2009 Thomas ..... E05B 81/76 296/146.1
2010/0237635 A1 * 9/2010 Ieda ..... E05B 81/78 292/336.3
2011/0309912 A1 12/2011 Muller
2012/0119524 A1 5/2012 Bingle et al.
2013/0170241 A1 * 7/2013 Lesueur ..... E05B 77/06 362/501
2014/0015262 A1 * 1/2014 Da Deppo ..... E05B 77/06 292/336.3
2014/0117683 A1 * 5/2014 Saitou ..... E05B 79/06 292/336.3
2014/0197649 A1 * 7/2014 Hansen ..... B60R 11/04 292/336.3
2014/0203574 A1 * 7/2014 Noda ..... E05B 81/77 292/336.3
2015/0059424 A1 * 3/2015 Hunt ..... E05B 81/76 70/262
2015/0315812 A1 * 11/2015 Vasi ..... E05B 5/006 292/336.3
2016/0123045 A1 * 5/2016 Bingle ..... E05B 81/76 292/336.3
2016/0138301 A1 * 5/2016 Schmitz ..... B64D 11/003 292/336.3
2016/0138307 A1 * 5/2016 Pohl ..... E05B 81/76 292/336.3
2016/0160539 A1 * 6/2016 Saitou ..... E05B 85/16 292/336.3
2019/0078360 A1 * 3/2019 Blount ..... E05B 85/103

* cited by examiner

HANDLE ASSEMBLY FOR A MOTOR VEHICLE DOOR

CROSS-REFERENCE TO RELATED APPLICATIONS

The present application is a 35 U.S.C. Section 371 national stage filing of International Patent Application No. PCT/US2015/022711, filed 26 Mar. 2015, and through which priority is claimed to U.S. Provisional Patent Application No. 61/970,715, filed on 26 Mar. 2014. The disclosures of the foregoing applications are incorporated herein by reference in their entireties.

FIELD OF THE INVENTION

The invention relates generally to motor-vehicle door handles and, more particularly, to a motor-vehicle door-handle assembly having a closure which is selectively opened to permit user access to a chamber or pocket disposed within a vehicle door.

BACKGROUND

Door handles for motor vehicles are generally old and well-known and, in their most common conventional form, comprise strap-style handles protruding outwardly from the exterior surface of the door. Typically, these handles are mechanically coupled to a latch mechanism disposed within the door and operative to securely latch the door in a closed condition. Upon actuation of the handle by a user, the latch mechanism is released to permit the door to be opened.

More recently, electromechanical mechanisms have been introduced to effect both locking and unlocking of the door latch, as well as actuation of the latch mechanism upon user actuation of the handle. With respect to locking and unlocking of the door latch, user-carried remote controls (typically in the form of a "key fob" remote) can passively or actively broadcast one or more signals that are detected by the vehicle and cause, via the vehicle's on-board computer, the latch mechanism to be locked or unlocked. With respect to actuation of the latch mechanism itself, the operative connection between the handle and the latch may be electrical, such that user actuation of the handle generates a signal which effects operation of the latch mechanism—e.g., through a servo-motor. These electromechanical latch-release assemblies have resulted in the introduction of various means for generating the signal to effect operation of the latch mechanism, including touch sensors, pressure sensors, switches, etc. By disposing such electronics at the exterior surface of the vehicle door, they are exposed to the elements and more prone to damage and accelerated degradation.

Still more recently, there have been introduced pop-up handles characterized by the fact that the user-actuatable handle portion is disposed substantially flush against the exterior surface of the vehicle door until, via remote-control signal, the handle is moved by a motorized mechanism to a deployed position in which a user can actuate the handle to unlatch and open the vehicle door. Pop-up handle mechanisms are somewhat complicated in their construction, are subject to blockage by ice build-up in colder climates and, moreover, must meet significant strength requirements.

SUMMARY

There is disclosed herein a handle assembly for a vehicle door. In a first embodiment, the handle assembly comprises:

a body defining an opening dimensioned to at least partially receive therein a hand of a user, the opening communicating with a chamber defined in the body anterior of the opening; a closure positioned in the opening, the closure selectively moveable relative to the body between a first position, in which the closure closes the opening, and a second position, in which the closure is moved into the chamber so that the hand of the user may be received through the opening; a motor for selectively moving the closure between the first and second positions thereof; at least one light-transmissive portion positioned proximate the opening of the body; and one or more light sources operative to selectively illuminate the at least one light-transmissive portion when the closure is in at least one of the first or second positions thereof.

According to one feature, the one or more light sources are operative to selectively illuminate the at least one light-transmissive portion in any of two or more colors of light.

Per another feature, the one or more light sources are operative to selectively illuminate the at least one light-transmissive portion in a first color of light when the closure is in the first position thereof, and to selectively illuminate the at least one light-transmissive portion in a second, different color of light when the closure is in the second position thereof.

According to yet another feature, the at least one light-transmissive portion comprises a light-transmissive portion positioned about the entire perimeter of the opening.

According to still another feature, there is provided a sensor actuatable by the hand of the user, the sensor operatively connectable to a latch mechanism for latching and unlatching a vehicle door. The sensor may, for instance and without limitation, be selected from the group including capacitive sensors, pressure sensors, and infrared sensors.

Also disclosed is a motor vehicle including at least one door by which a user can enter and exit the vehicle, the at least one door being characterized by a locked state, in which the door cannot be opened by the user, and an unlocked state, in which the door can be unlatched and opened by the user via a handle assembly disposed on the at least one door. The motor vehicle comprises an improved handle assembly including: a body secured to the at least one door, the body having an opening therein which opens onto an exterior surface of the at least one door, the opening dimensioned to at least partially receive the hand of the user, and the opening communicating with a chamber of the body that is disposed within an interior of the at least one door; a closure positioned in the opening, the closure selectively moveable between a first position, in which the closure closes the opening, and a second position, in which the closure is moved into the chamber of the body so that the hand of the user may be received through the opening; a motor disposed within the interior of the at least one door for selectively moving the closure between the first and second positions thereof; at least one light-transmissive portion positioned proximate the opening of the body so as to be visible at the exterior surface of the at least one door; and one or more light sources operative to selectively illuminate the at least one light-transmissive portion when the closure is in at least one of the first or second positions thereof.

Per one feature, the one or more light sources are operative to selectively illuminate the at least one light-transmissive portion in any of two or more colors of light.

According to another feature, the one or more light sources are operative to selectively illuminate the at least one light-transmissive portion in a first color of light when the closure is in the first position thereof, and to selectively illuminate the at least one light-transmissive portion in a second, different color of light when the closure is in the second position thereof.

Per still another feature, the at least one light-transmissive portion comprises a light-transmissive portion positioned about the entire perimeter of the opening.

According to still another feature, there is provided a sensor actuatable by the hand of the user, the sensor operatively connectable to a latch mechanism for latching and unlatching a vehicle door. The sensor may, for instance and without limitation, be selected from the group including capacitive sensors, pressure sensors, and infrared sensors.

According to still another feature, there is provided a controller operatively connected to the one or more light sources to control the selective illumination of the at least one light-transmissive portion. The controller may, according to one feature, be responsive to one or more signals from a remote control to selectively illuminate the at least one light-transmissive portion in a first color of light when the closure is in the first position thereof, at least one light-transmissive portion in a second, different color of light when the closure is in the second position thereof.

According to still another feature, there is provided a controller operatively connected to the motor to control the selective movement of the closure between the first and second positions thereof. The controller may, according to one feature, be responsive to signals from the remote control to effect selective movement of the closure between the first to the second positions thereof.

According to still another feature, the controller operatively connected to the motor and the controller operatively connected to the one or more light sources are: (a) responsive to an unlock signal from the remote control to both illuminate the at least one light-transmissive portion in a first color of light and move the closure from the first to the second position thereof; and (b) responsive to a lock signal from the remote control to both illuminate the at least one light-transmissive portion in a second color of light and move the closure from the second to the first position thereof.

The controller operatively connected to the one or more light sources and the controller operatively connected to the motor may be the same controller or different controllers.

In a second embodiment, the handle assembly includes: a body defining an opening dimensioned to at least partially receive therein a hand of a user, the opening communicating with a chamber defined in the body anterior of the opening; at least one pivot arm mounted on the body for pivotal movement relative thereto; a closure for the opening, the closure connected to the at least one pivot arm for pivotal movement relative thereto, and the closure selectively moveable relative to the body between a first position, in which the closure occupies the opening, and a second position, in which the closure is moved into the chamber so that the hand of the user may be received through the opening; and a motor for effecting selective movement of the closure between the first and second positions thereof. In movement from the first position to the second position of the closure, the at least one pivot arm pivotally moves relative to the body in a first direction and the closure pivotally moves relative to the at least one pivot arm in a second direction which is opposite the first direction.

According to one feature, the handle assembly includes a sensor actuatable by the hand of the user, the sensor operatively connectable to a latch mechanism for latching and unlatching a vehicle door. By way of example, the sensor may be selected from the group consisting of capacitive sensors, pressure sensors, and infrared sensors.

BRIEF DESCRIPTION OF THE DRAWINGS

Embodiments will now be described, by way of example only, with reference to the attached Figures, wherein:

FIGS. 1A-12 depict the handle assembly of the present invention according to a first exemplary embodiment.

FIG. 1A shows the handle assembly of the present invention as seen from the exterior of a vehicle door, with the closure in the first, closed position thereof;

FIG. 2 shows the handle assembly as seen from the inside of a vehicle door (with the interior trim removed);

FIG. 3 is an overhead perspective view of the handle assembly of FIG. 2;

FIG. 4 is an underside perspective view of the handle assembly of FIG. 2;

FIG. 5 is a lateral perspective view of the handle assembly of FIG. 2;

FIG. 6 is a rear perspective view of the handle assembly of FIG. 2;

FIG. 7 is a front view of the handle assembly of the present invention, shown separate from a vehicle door;

FIG. 8 is a quartering perspective view of the handle assembly of FIG. 7, with the closure removed from the drawing to better illustrate the remainder of the assembly;

FIG. 9 is a rear view of the handle assembly of FIG. 7;

FIG. 10 is a rear quartering perspective view of the handle assembly of FIG. 7;

FIG. 11 is an overhead perspective view of the motor, motor mount portion, and closure of the handle assembly of FIG. 7; and FIG. 12 is a schematic depiction of an exemplary interrelationship between the handle assembly and one or more controllers.

FIG. 13 is an exploded perspective view of the several components of the handle assembly according to a second embodiment of the present invention, with a section of the vehicle door panel also depicted;

FIGS. 14 and 15 are perspective views taken from opposite sides of the handle assembly of the second embodiment, with a section of the vehicle door panel also depicted;

FIG. 16 is a cross-sectional view of the handle assembly of the second embodiment, taken along line A-A of FIG. 14;

FIGS. 17 and 18 are perspective views of the handle assembly of the second embodiment (with the back panel removed) showing the closure in, respectively, the closed and opened conditions thereof; and FIGS. 19 and 20 are alternate perspective views of the handle assembly of the second embodiment (with the back panel removed) showing the closure in, respectively, the closed and opened conditions thereof.

DETAILED DESCRIPTION OF EMBODIMENTS

Figure 1A:
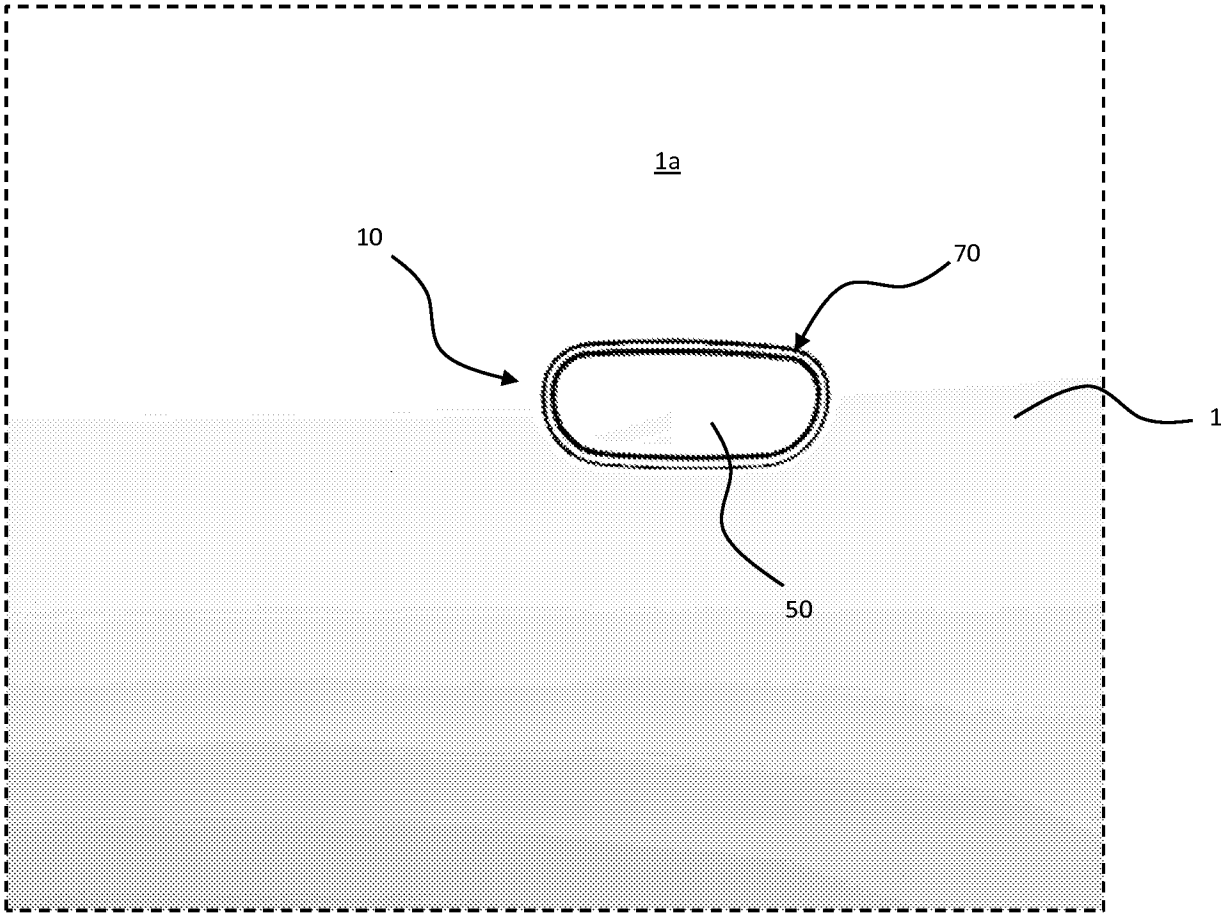

Referring now to the drawings, there is disclosed herein a handle assembly for a motor-vehicle door.

In a first embodiment, shown in FIGS. 1A-12 (wherein like numbers indicate like or corresponding parts), the handle assembly 10 is shown in FIGS. 1A-6 in the operational environment thereof; i.e., associated with a motor-vehicle door.

Generally, the handle assembly 10 comprises a body (indicated generally at 20) defining an opening 21 dimensioned to receive therein a hand of a user. The opening 21 communicates with a pocket, or chamber 23, defined in the body anterior (relative to the exterior surface of a vehicle door) of the opening 21. As shown, the opening 21 communicates with the area outside of a motor-vehicle through the exterior 1*a* surface of the door panel 1 (shown in FIGS. 1A and 1B) such that, also as shown, the chamber 23 is disposed within the vehicle door when the handle assembly 10 is mounted thereon.

A closure 50 positioned in the opening 21 is selectively moveable between a first position (FIG. 1A), in which the closure 50 closes the opening 21, and a second position (FIG. 1B), in which the closure 50 is moved into the chamber 23 so that the hand of the user may be at least partially received in the opening.

A motor 60 for selectively moving the closure 50 between the first, closed, and second, open, positions thereof is mounted on the body.

Figure 7:
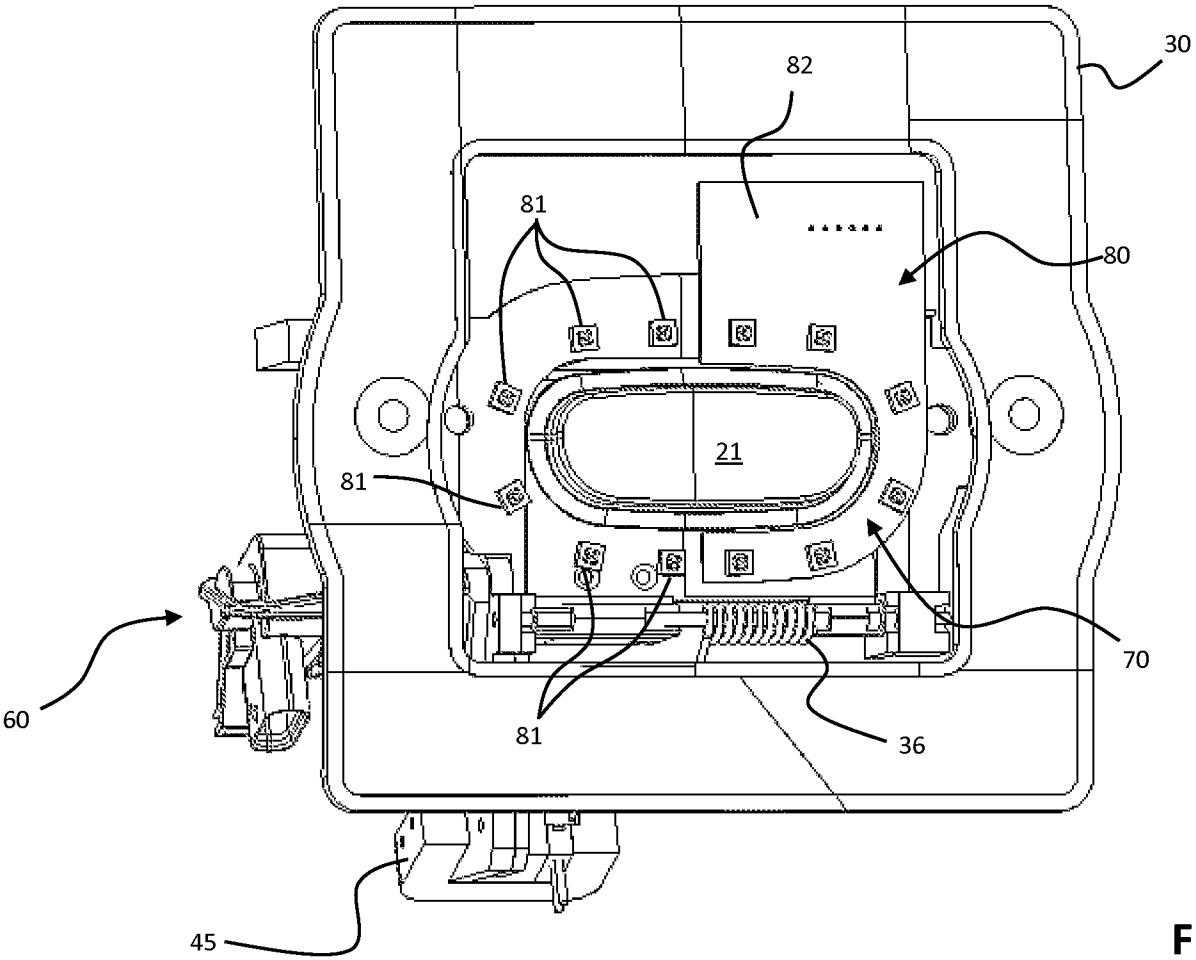
Figure 8:
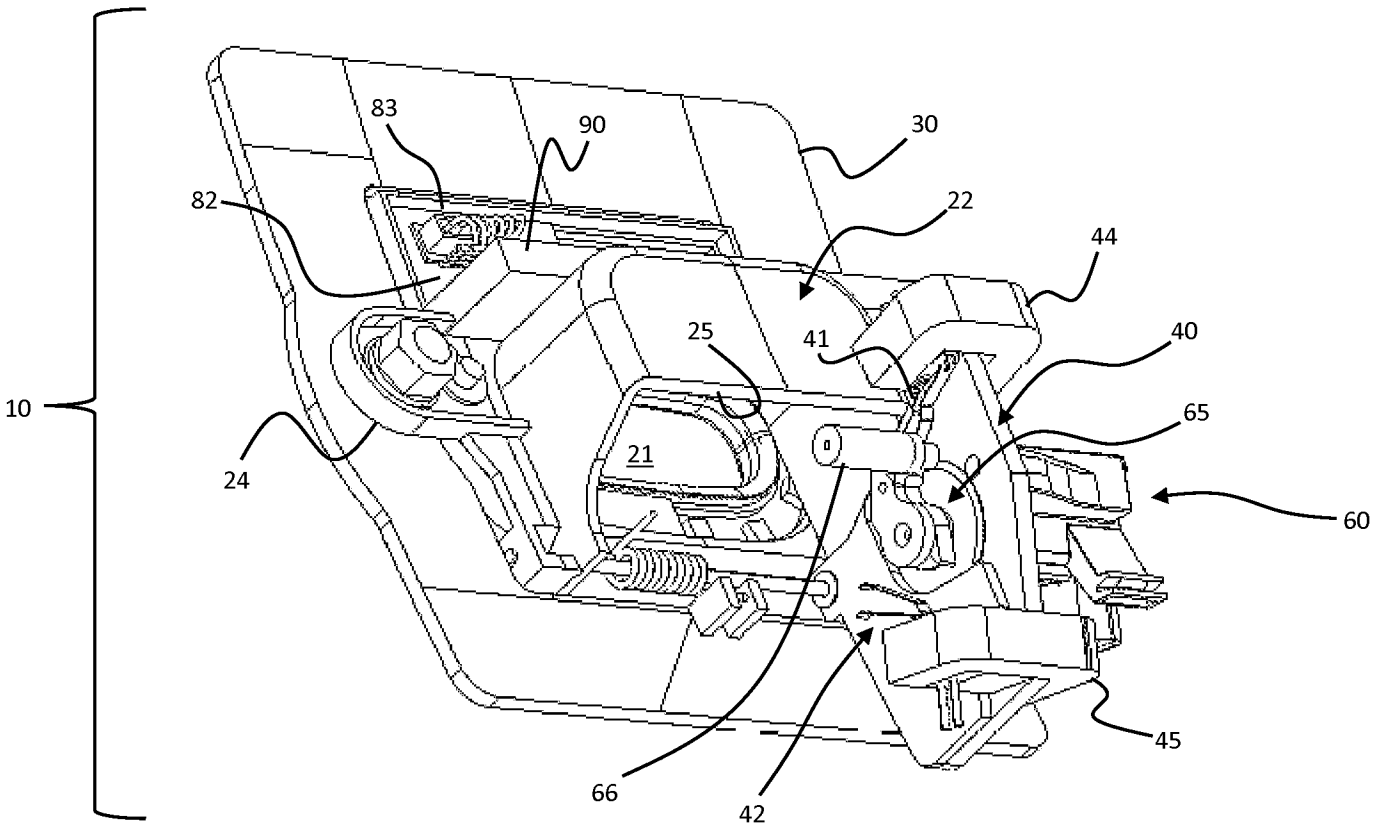

As best shown in FIGS. 1A and 7, at least one light-transmissive portion 70 is mounted on the body and positioned proximate the opening 21.

With specific reference also to FIGS. 2-6, one or more light sources 80 mounted on the body are operative to selectively illuminate the at least one light-transmissive portion 70 when the closure is in at least one of the first or second positions thereof.

Body 20 is comprised of several elements which may be monolithic or, as shown, unitary, including a frame portion 30 configured to lie adjacent an interior surface 1*b* of the vehicle door panel 1, a central portion 22 defining the chamber 23, and a motor-mount portion 40. Laterally-projecting portions 24 on either side of the central portion 22 define mounting points for securement of body 20, such as by screws, bolts, etc., to the interior 1*b* of the vehicle door panel 1.

Optionally, one or more gaskets, seals, or the like may be interposed between the body and the vehicle door panel interior surface to seal the handle assembly against the incursion of moisture, debris, etc.

With specific reference to FIGS. 2, 4-6, 8, 10 and 11, central portion 22 can be seen to be open along the bottom thereof, with the lower edge 25 defining a stop surface for the door closure arm 51 as hereafter described.

Proximate the top of central portion 22 is provided a sensor 90 actuatable by the hand of the user. In conventional manner, sensor 90 is operatively connectable to a latch mechanism (not depicted) for latching and unlatching the vehicle door. To facilitate user interaction with sensor 90, the top of central portion 22 is open as necessary. For instance, in the illustrated embodiment the top of central portion 22 is open to permit one or more of the user's fingers to come in close proximity to, or in contact with, the sensor 90 (as the sensor of the illustrated embodiment is a capacitive, or "touch," sensor). Of course, the sensor 90 may be any type of sensor, such as, by way of example and without limitation, a pressure sensor or an infrared sensor; and it will be understood that the disposition of the sensor proximate the chamber 23 will vary according to the type of sensor employed, subject only to the requirement that a user be able to interact with the sensor when his or her hand is at least partially received through the opening 21.

Figure 3:
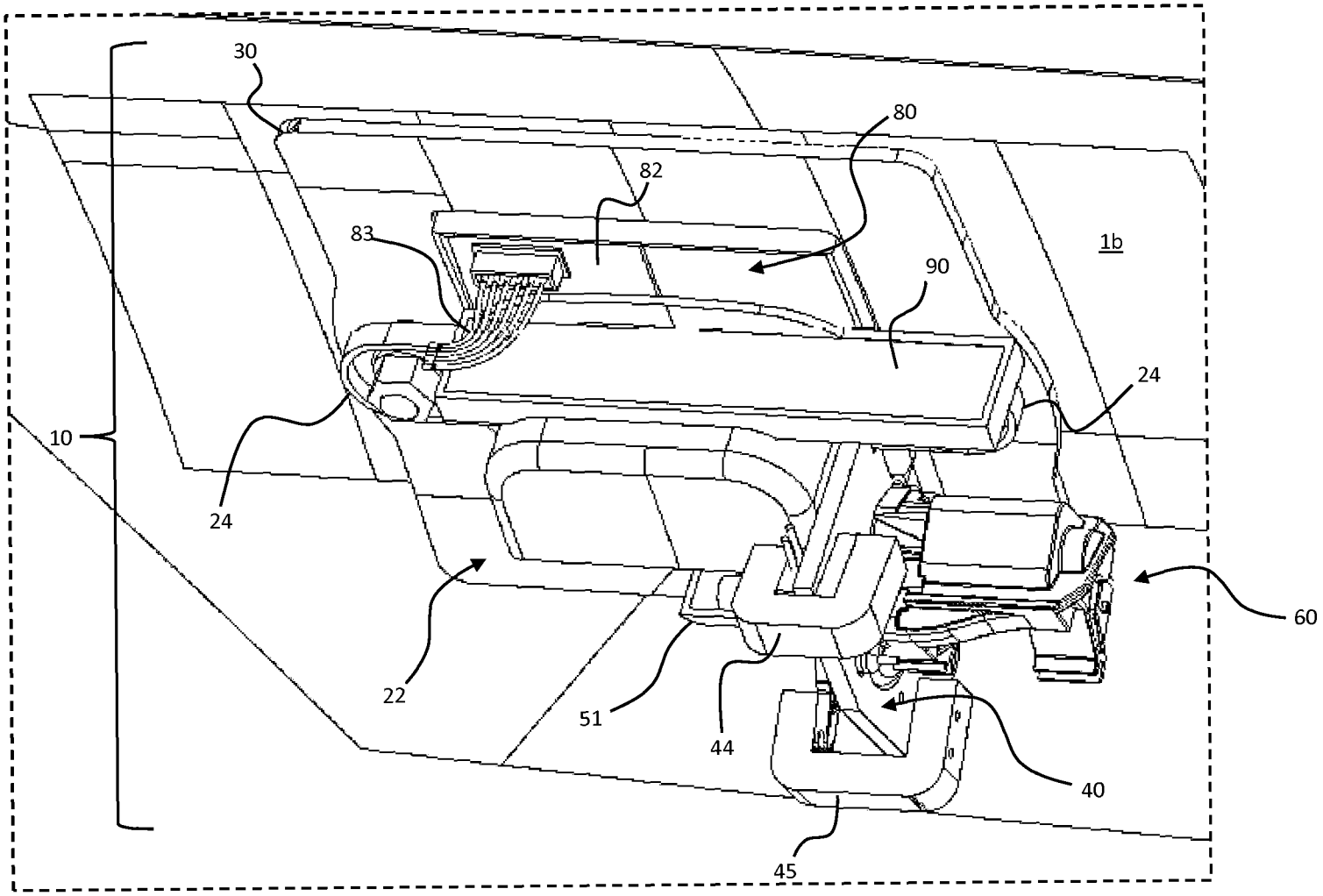
Figure 4:
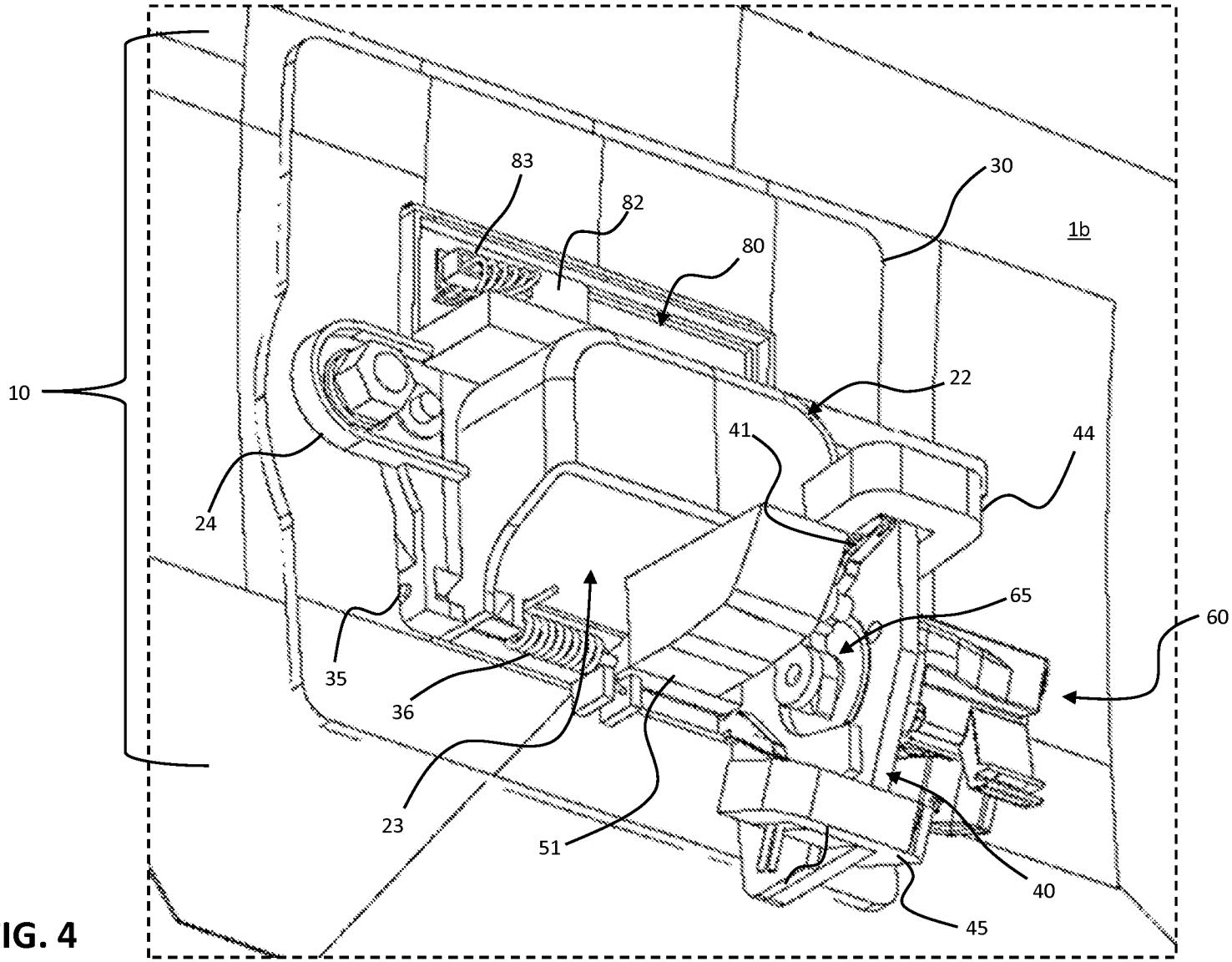
Figure 9:
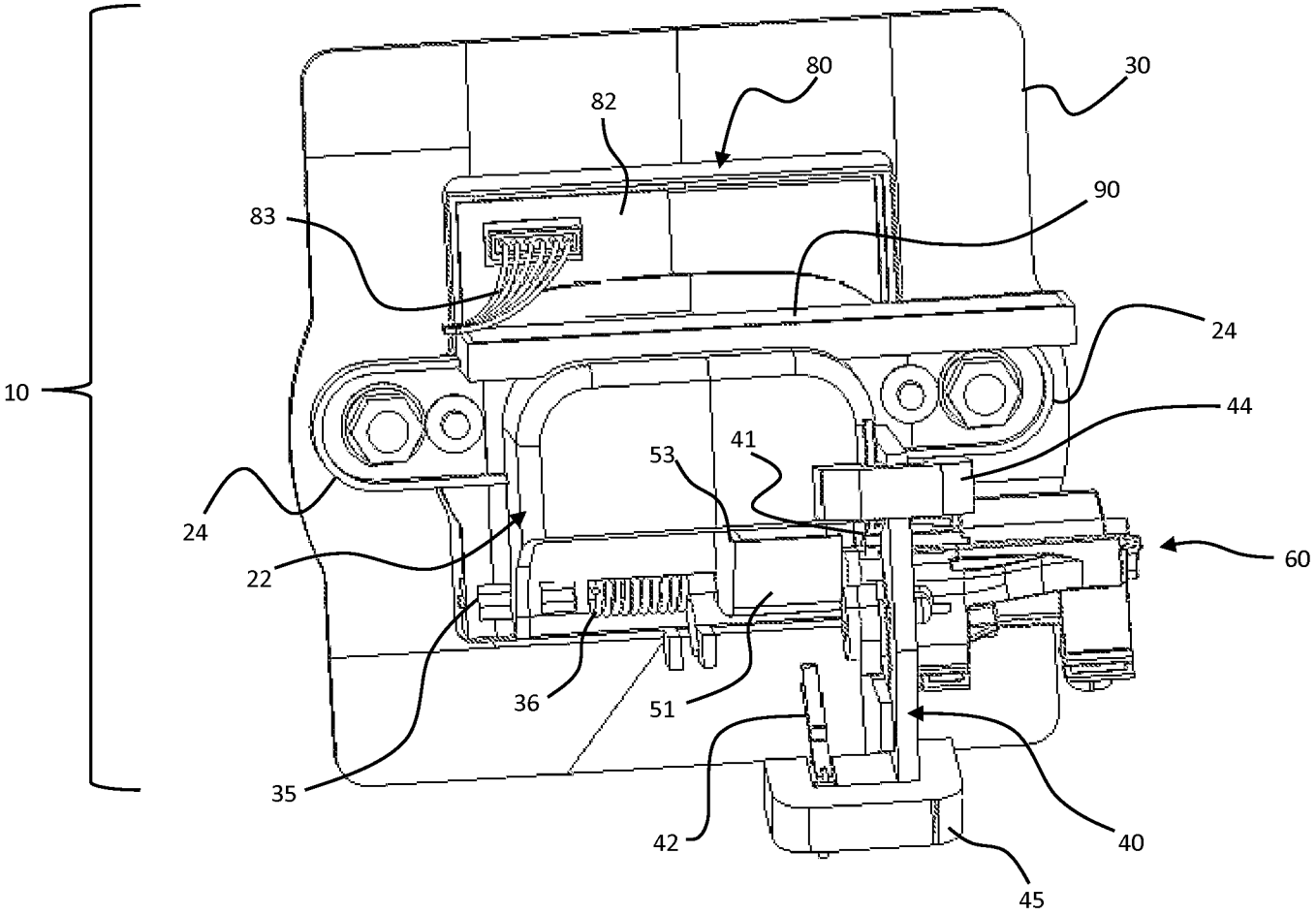
Figure 10:
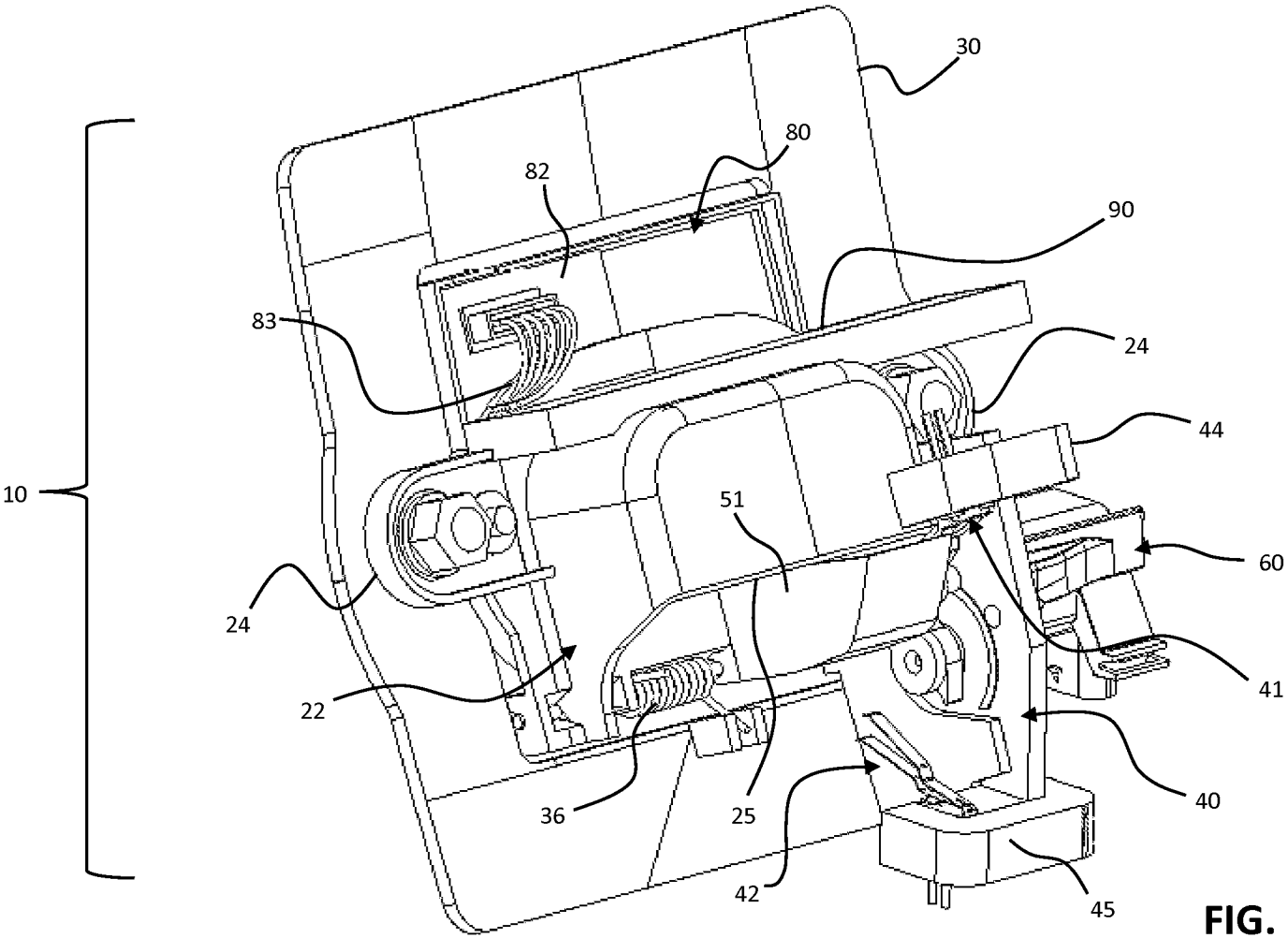
Figure 11:
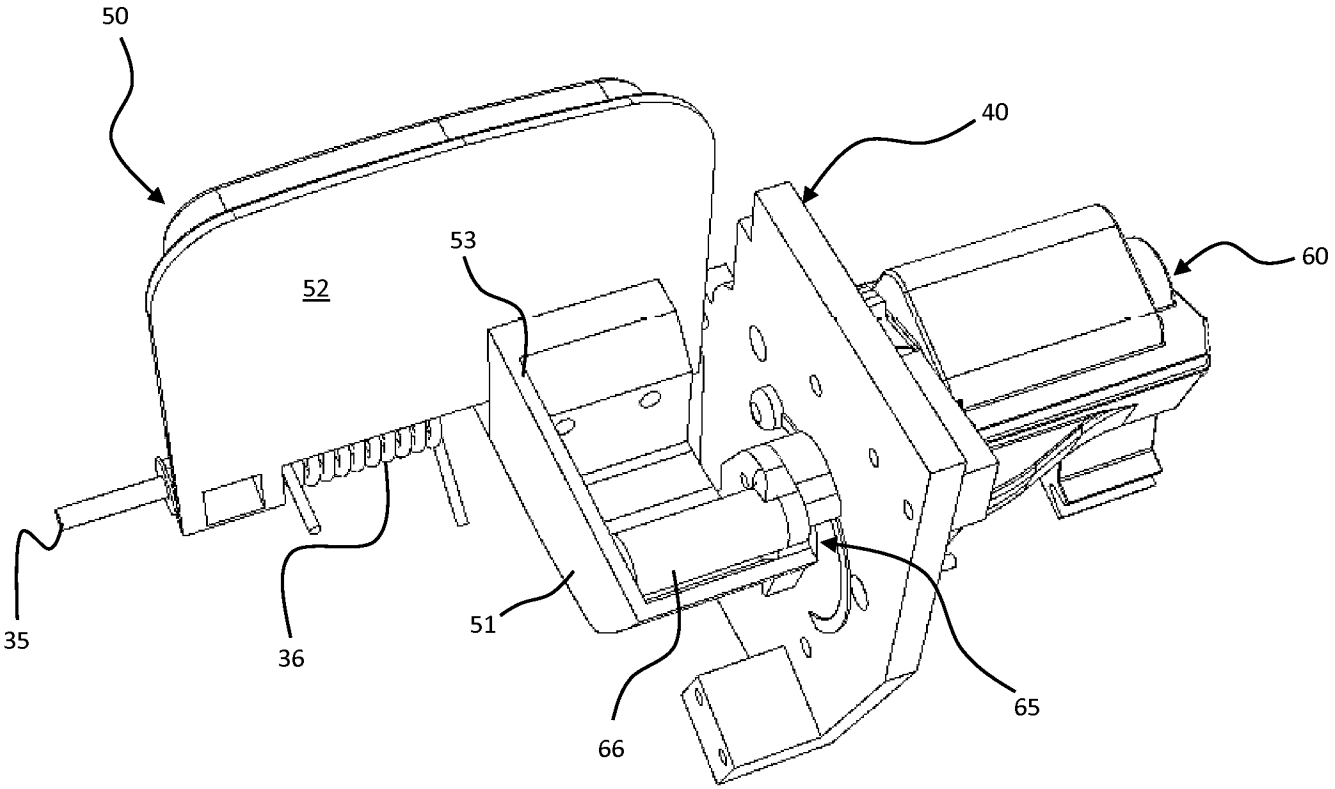
Figure 12:
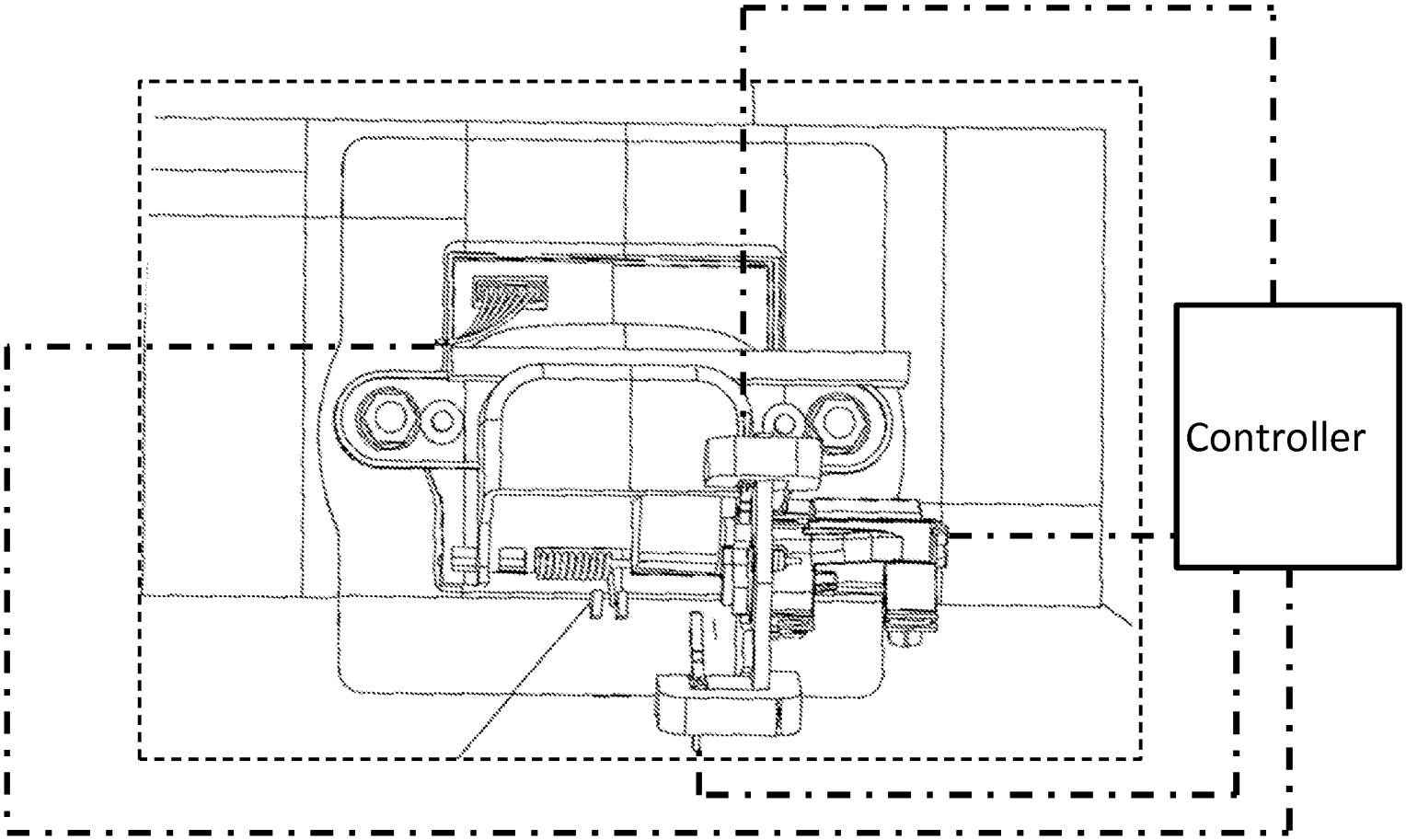

With reference again being had to FIGS. 1A, 7 and 11, closure 50 is will be seen to have a shape conforming generally to the shape of the opening 21, such that the closure 50 in the first position substantially occupies the opening 21 to prevent receipt of a user's hand therein. Projecting from the rear surface of the closure 50—that is, the surface facing the chamber 23—there is provided closure arm 51. According to the illustrated embodiment, closure arm 51 may be seen to comprise a somewhat trough-shaped member extending generally orthogonally relative to the rear surface 52 of closure 50. As best seen in FIGS. 3, 9 and 11, closure arm 51 is open at the top and along a side adjacent the motor mount 40. The top surface 53 abuts the lower edge 25 when the closure is the first position thereof, as described further below. The open interior 54 of closure arm 51 receives the pin 66 of closure actuator 65.

With reference to FIGS. 2, 4, and 6-11, closure 50 is pivotally-mounted on the body central portion 22 via a rod 35. Rod 35 extends between mounts 26 defined along the central portion 22. A torsion spring 36 is disposed along the length of the pin between the closure arm 51 and a mounting flange 55 of the closure. The opposite, radial ends of torsion spring 36 are oriented to abut, at one end, the lower edge 56 of closure 50 and, at the other end, the surface of frame portion 30 (where it is captured between opposing flanges 31, 32). By this orientation, spring 36 may be understood to bias closure 50 to the first, closed position thereof.

Figure 5:
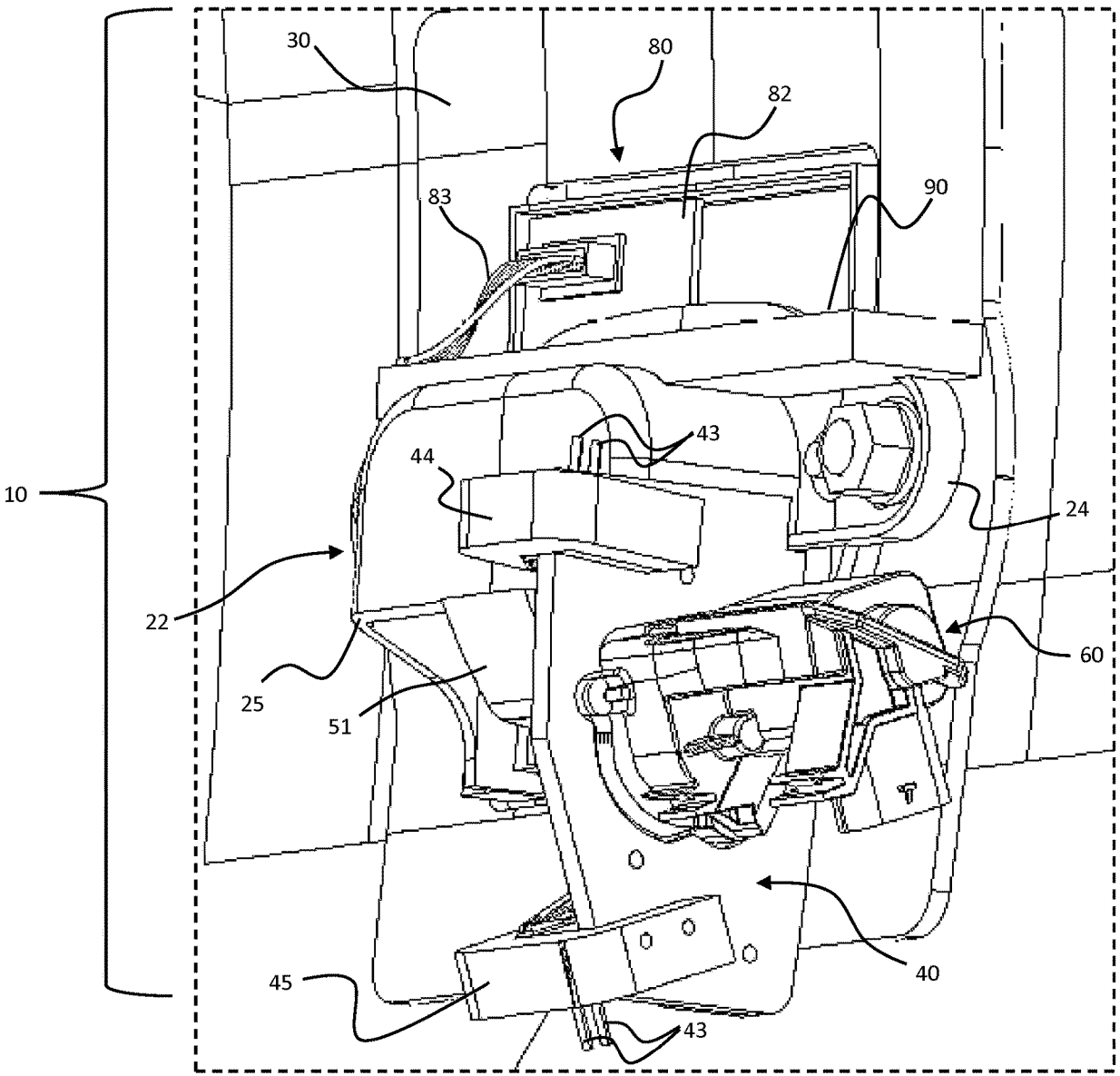
Figure 6:
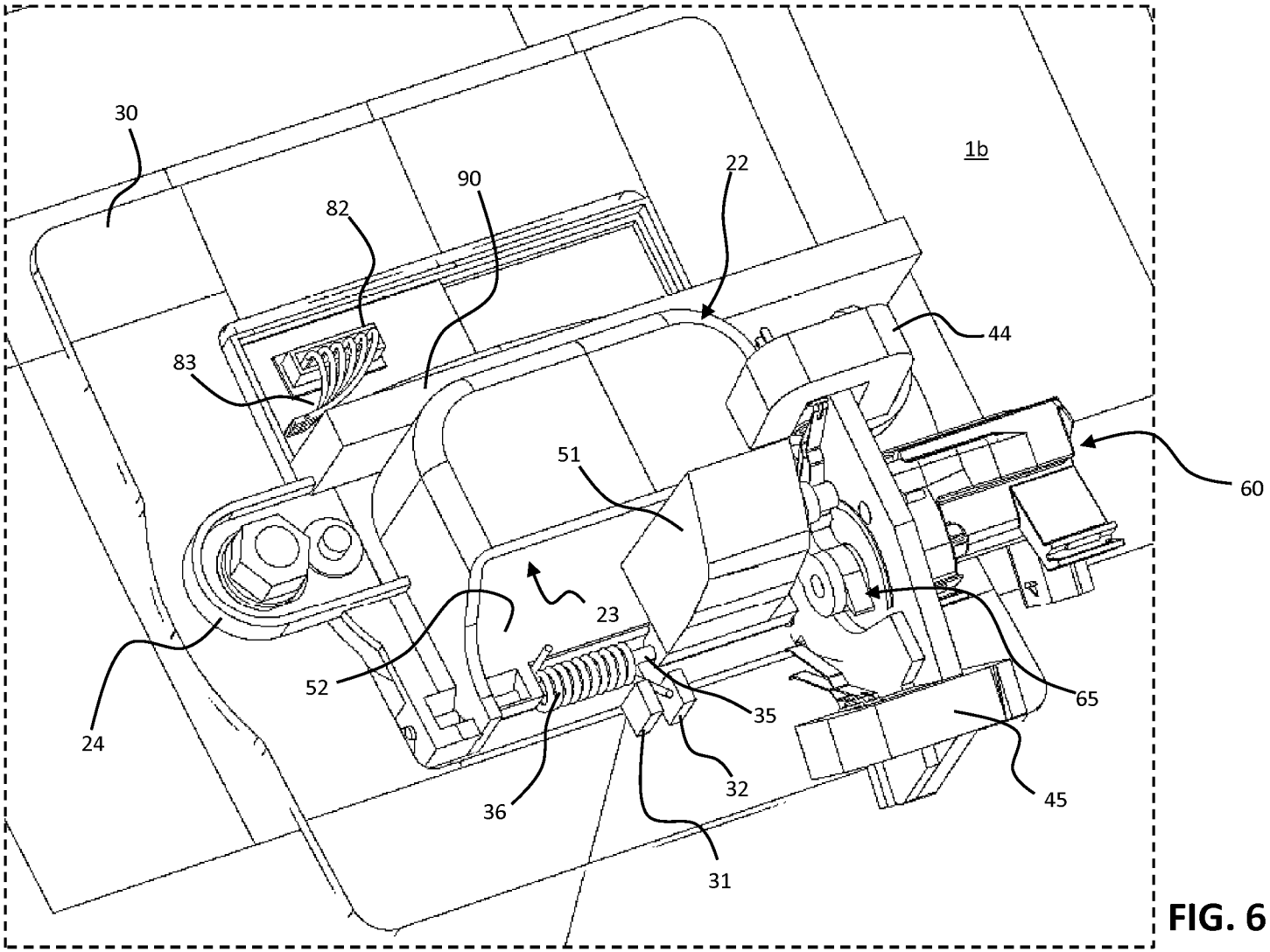

With reference also being had to FIGS. 3 and 5, motor 60 is secured to motor-mount portion 40. Motor 60 is connectable to a controller (see FIG. 12) operative to control the selective movement of the closure 50 between the first and second positions thereof, as described further below. Motor 60 is also connectable to a suitable power source (see FIG. 12), which may be a locally-positioned battery or batteries or another, remotely-disposed power source of the motor vehicle (e.g., the vehicle's main battery). Motor 60 turns a rotatable drive shaft that extends through the motor-mount portion to connect to the closure actuator 65. Closure actuator 65 is secured to the drive shaft so as to be rotatable therewith. Pin 66 is positioned on closure actuator 65 so as to be offset from the axis of the drive shaft, whereby rotation of the closure actuator 65 upon rotation of the drive shaft in a first direction effects movement of the pin about an arc which causes the pin 66 to carry with it the closure arm 51. This necessarily causes the closure 50 to pivot about the rod 35, thereby moving closure 50 from the first to the second position thereof. When the motor drive shaft rotates in the opposite direction, on the other hand, the closure actuator 65 correspondingly rotates, carrying pin 66 with it. By the biasing action of the spring 36, closure 50 pivots about the rod 35 until the top surface 53 abuts the lower edge 25 when the closure returns to the first position thereof. By the foregoing description, it will be appreciated that, according to the illustrated embodiment, motor 60 selectively moves the closure 50 between the first and second positions thereof even though the motor 60 doesn't actually drive the closure 50 back to the first position from the second position thereof. That is, operation of the motor 60 is necessary to move the closure back to its first position (which movement is accomplished through the biasing action of the spring 36), as the position of pin 66 in the second position of the closure 50 would otherwise prevent movement of the closure arm 51.

At opposite ends of the motor mount portion 40 are provided limit switches 41, 42, each of which is operatively connected (such as via wires 43) to the motor controller (not shown) and, as necessary, a source of power. In the illustrated embodiment, limit switches 41, 42 are disposed on mounts 44, 45 located at opposite ends of motor-mount portion 40. The lower limit switch 42 is positioned to be actuated by the closure arm 51 when closure is in the second position thereof, while the upper limit switch 41 is positioned to be actuated by the closure actuator 65 when closure 50 is in the first position thereof. The motor controller is programmed to reset the motor 60 when each limit switch 41, 42 is actuated, such that the motor will thereafter rotate in the opposite direction upon its next activation. In other words, actuation of the lower limit switch 42 results in the motor 60 being reset so that the drive shaft thereof rotates in next actuation of the motor in the direction which permits movement of closure 50 back to the first position thereof. Conversely, actuation of the upper limit switch 41 results in the motor 60 being reset so that the drive shaft thereof rotates in next actuation of the motor in the direction which moves closure 50 to the second position thereof.

Optionally, motor 60 is effectively locked at the end of each cycle, such that, in the first position of the closure especially, the closure may not be forced open to permit access to the sensor. Alternatively, and particularly where the sensor is programmed to be operative only in circumstances where the vehicle's on-board computer (such as the body control module, for instance) detects the authorized signal of the vehicle's "key fob" remote control, it may be desirable that the closure can be forced to its second position in the event a vehicle power failure prevents powered operation of the motor 60.

Referring now to FIGS. 2-11, the one or more light sources 80 may be seen to comprise, in the illustrated embodiment, a plurality of LEDs 81 arranged about the opening 21 so as to be in proximity to the light-transmissive portion 70. A printed circuit board 82, or PCB, is operatively connected to the LEDs and, via wiring 83, is operatively connectable to the motor-vehicle's body control module or other computer or controller and, as necessary, a source of power, so as to power and selectively operate the LEDs or other light sources in the manner hereafter described.

LEDs or other light sources may be multi or monochromatic; and, where multiple light sources are provided (as shown in the exemplary embodiment), each may be the same or differently colored. In the exemplary embodiment, the one or more light sources 80 are operative to selectively illuminate the at least one light-transmissive portion 70 in any of two or more colors of light; and, more particularly, to selectively illuminate the at least one light-transmissive portion 70 in a first color of light when the closure 50 is in the first position thereof, and to selectively illuminate the at least one light-transmissive portion in a second, different color of light when the closure 50 is in the second position thereof.

Figure 1B:
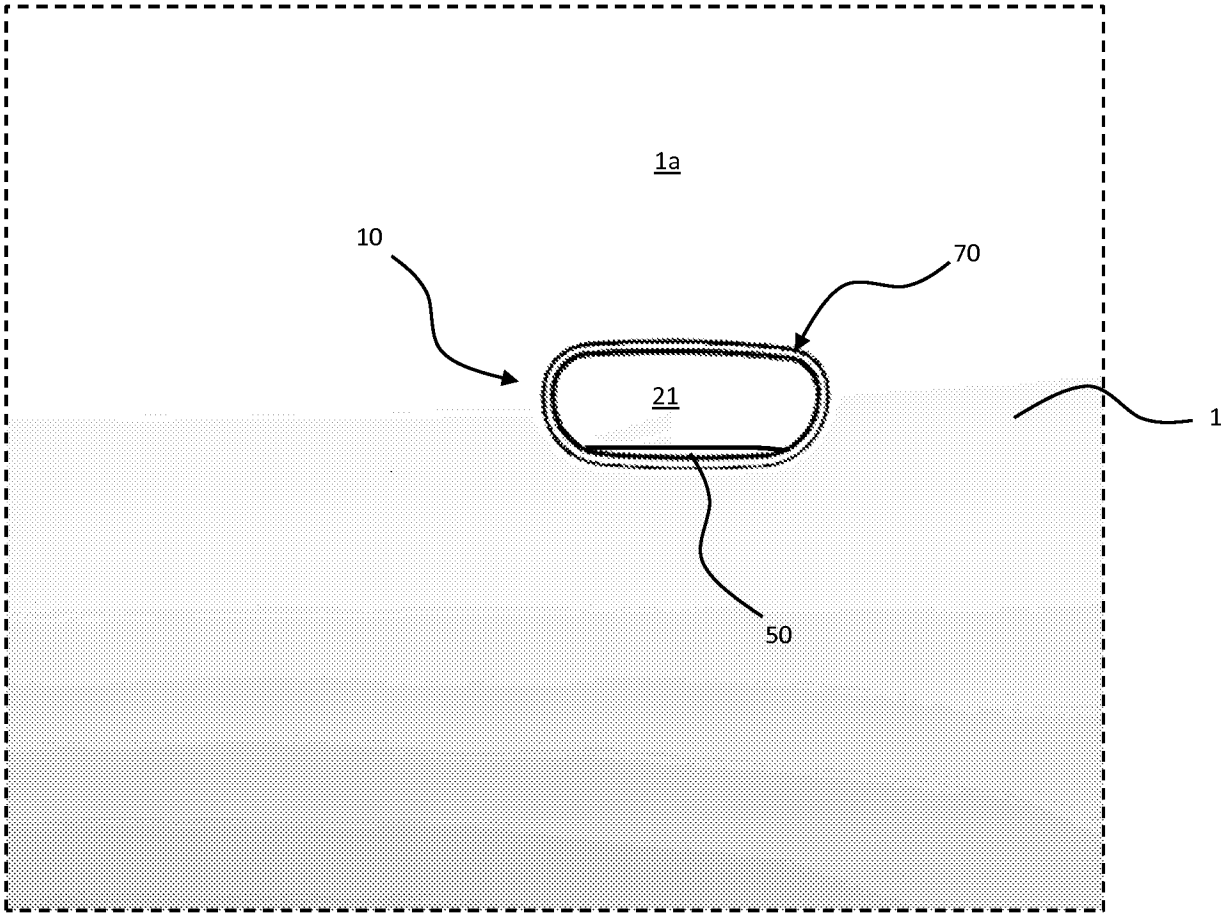
FIG. 1B shows the handle assembly of FIG. 1A, with the closure shown in the second, open position thereof.
Figure 2:
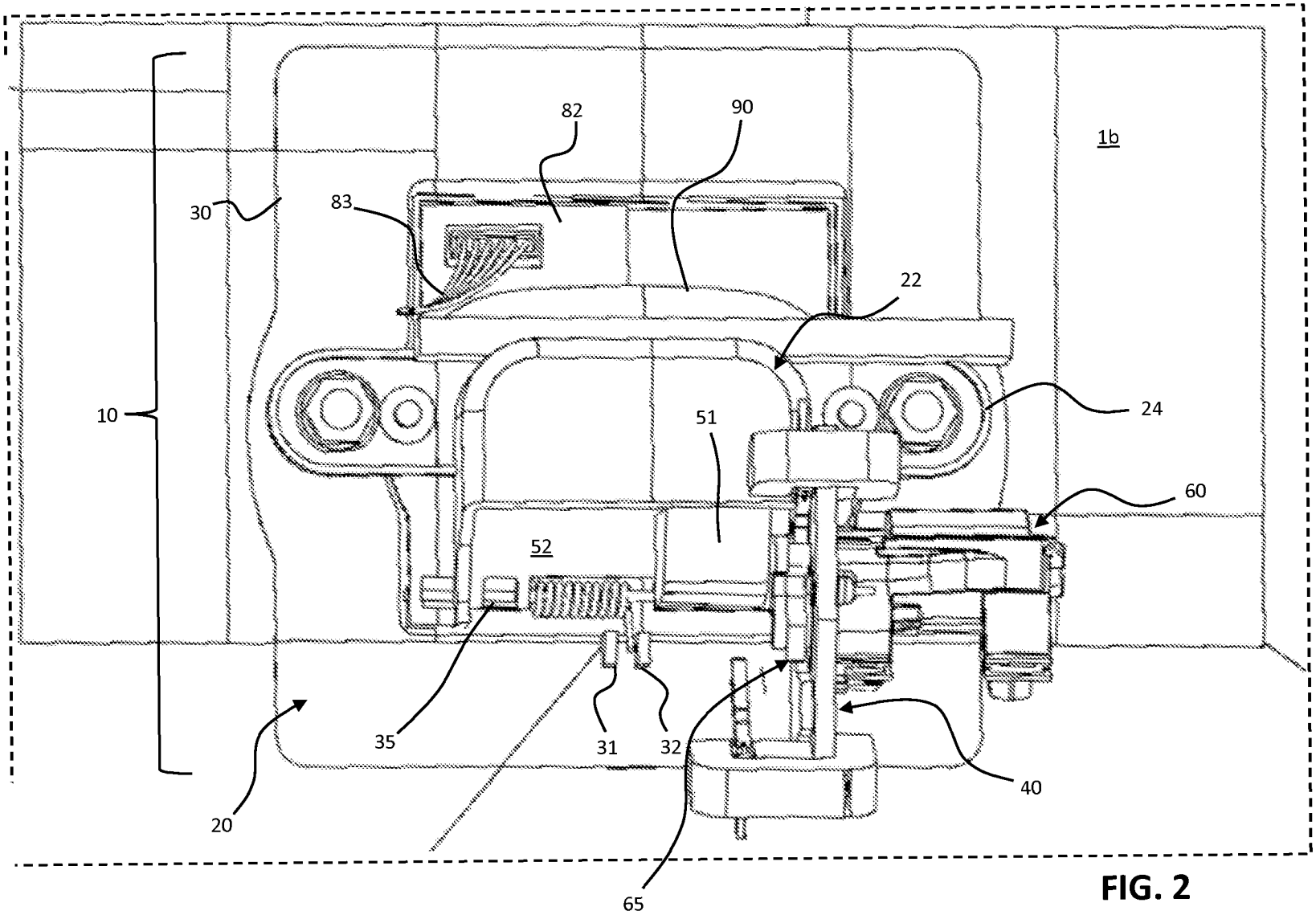

The at least one light-transmissive portion 70 may comprise a light-transmissive plastic element which, according to the illustrated embodiment, defines a "light-pipe"-like member including a cut-out portion corresponding to the shape of the opening 21. The light-transmissive portion overlies the LEDS so as to channel the illumination therefrom to the area surrounding the opening 21. As best shown in FIGS. 1A and 1B, however, it will be appreciated that, upon installation of the handle assembly, only a relatively small, generally oval-shaped portion of the light-transmissive portion is visible from the exterior of the vehicle.

According to the embodiment as described, light-transmissive portion 70 is positioned about the entire perimeter of opening 21 to selectively provide illumination sufficient to identify the location of the opening 21. It is also contemplated, however, that the light-transmissive portion may be differently shaped than as herein exemplified, and may comprise, for instance, one or multiple light-transmissive portions.

In use, the handle assembly of the present invention is installed in a motor vehicle including at least one door by which a user can enter and exit the vehicle. Per convention, the at least one door is characterized by a locked state, in which the door cannot be opened by the user, and an unlocked state, in which the door can be unlatched and opened by the user via a handle assembly disposed on the at least one door.

The body is secured to the at least one door so that the opening 21 opens onto an exterior surface of the door, with the chamber 23 of the body disposed within an interior of the door. (See FIGS. 1A and 1B.) The sensor 90 is operatively connected to a latch mechanism (not depicted) for latching and unlatching the vehicle door. The at least one light-transmissive portion 70 is positioned proximate the opening of the body portion so as to be visible at the exterior surface of the door.

In the exemplary embodiment, the one or more light sources (such as the LEDs 81) are operative to selectively illuminate the at least one light-transmissive portion 70 in any of two or more colors of light. More particularly, the one or more light sources are operative to selectively illuminate the at least one light-transmissive portion 70 in a first color of light when the closure 50 is in the first position thereof, and to selectively illuminate the at least one light-transmissive portion 70 in a second, different color of light when the closure 50 is in the second position thereof.

To effect operation of the one or more light sources, a computer or other controller, such as, for instance, the motor vehicle's body control module, is operatively connected to the one or more light sources to control the selective illumination of the at least one light-transmissive portion. See FIG. 12. The controller is programmed to be responsive to one or more signals (whether passively or actively generated) from a remote control, such as a conventional "key fob" remote, to selectively illuminate the at least one light-transmissive portion in a first color of light when the closure is in the first position thereof, and to selectively illuminate the at least one light-transmissive portion in a second, different color of light when the closure is in the second position thereof.

Likewise, to effect operation of the motor, a computer or other controller, such as, for instance, the motor vehicle's body control module or a local controller, is operatively connected to the motor to control the selective movement of the closure between the first and second positions thereof. See FIG. 12. The controller is programmed to be responsive to signals (whether passively or actively generated) from a remote control, such as a conventional "key fob" remote, to effect selective movement of the closure between the first to the second positions thereof.

Still more particularly, in the illustrated embodiment the controller operatively connected to the motor and the controller operatively connected to the one or more light sources are: (a) responsive to an unlock signal from the remote control to both illuminate the at least one light-transmissive portion in a first color of light and move the closure from the first to the second position thereof; and (b) responsive to a lock signal from the remote control to both illuminate the at least one light-transmissive portion in a second color of light and move the closure from the second to the first position thereof.

Of course, it will be appreciated from this disclosure that illumination of the at least one light-transmissive portion may be altered or augmented in any way desired. For instance, the one or more light sources may include puddle or ground-effect lighting which is activated in response to the vehicle's detection of the "key fob" remote within a predefined distance from the vehicle, the at least one light-transmissive portion may be illuminated in a specific color and/or a specified number of times in a predetermined sequence to indicate that the vehicle door is locked, etc.

It is likewise envisioned that the controller operatively connected to the one or more light sources and the controller operatively connected to the motor may be the same or different controllers.

Turning now to FIGS. 13-20, where like numbers refer to like or corresponding parts, there is shown an alternative embodiment of the invention in which the closure 140 is selectively moveable about dual pivot points as described more fully below. As with the first embodiment, the handle assembly comprises a body 100 defining an opening 101 dimensioned to at least partially receive therein a hand of a user. The opening 101 communicates with a pocket, or chamber 102, defined in the body anterior (relative to the exterior surface of a vehicle door) of the opening 101 (see FIGS. 16-20). A back cover 115 is secured (for instance by screws 116) to the body 100 opposite the opening 101. Optionally, the back cover 115 may have a separately formed skid plate 120 (made, for instance, of acetyl) positioned thereon so as to face the chamber 102.

Body 100 may be monolithic or unitary and is configured to lie adjacent an interior surface 1*b* of the vehicle door panel 1 and to be supported thereon in a manner such as hereafter described. For ease of understanding, portions of the body 100 are depicted in the drawings as being at least partially transparent so that the other elements of the assembly are visible. However, it will be understood that the body is preferably (though not necessarily) formed so as to be entirely opaque in use.

A motor-mount portion (indicated generally at 103) of the body 100 supports a motor 130 for driving movement of the closure 140 in the manner hereafter described.

Figure 13:
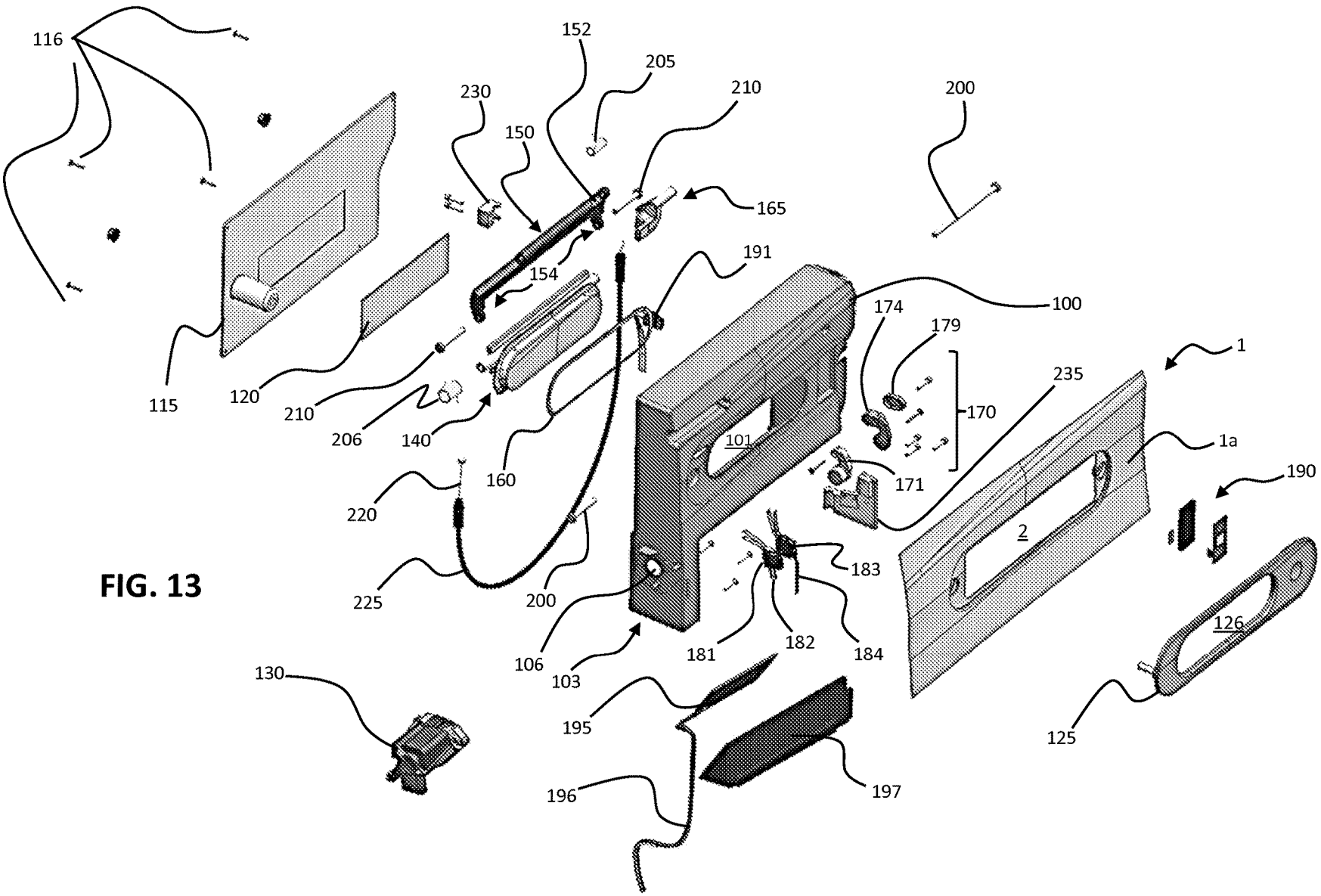
FIGS. 13-20 depict the handle assembly according to a second exemplary embodiment. Dashed lines around the drawings, where present, indicate the boundary of the depicted area.
Figure 14:
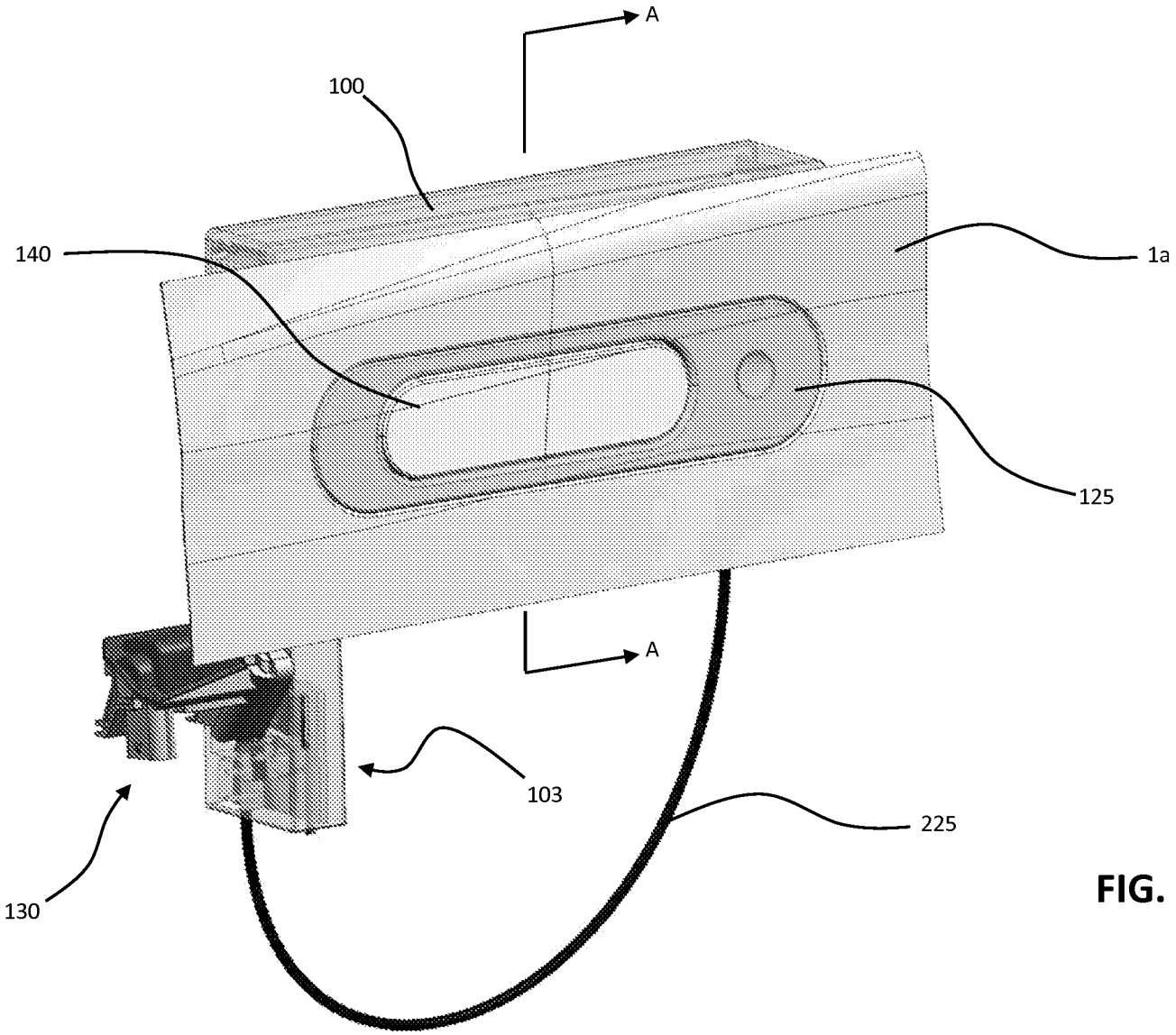
Figure 16:
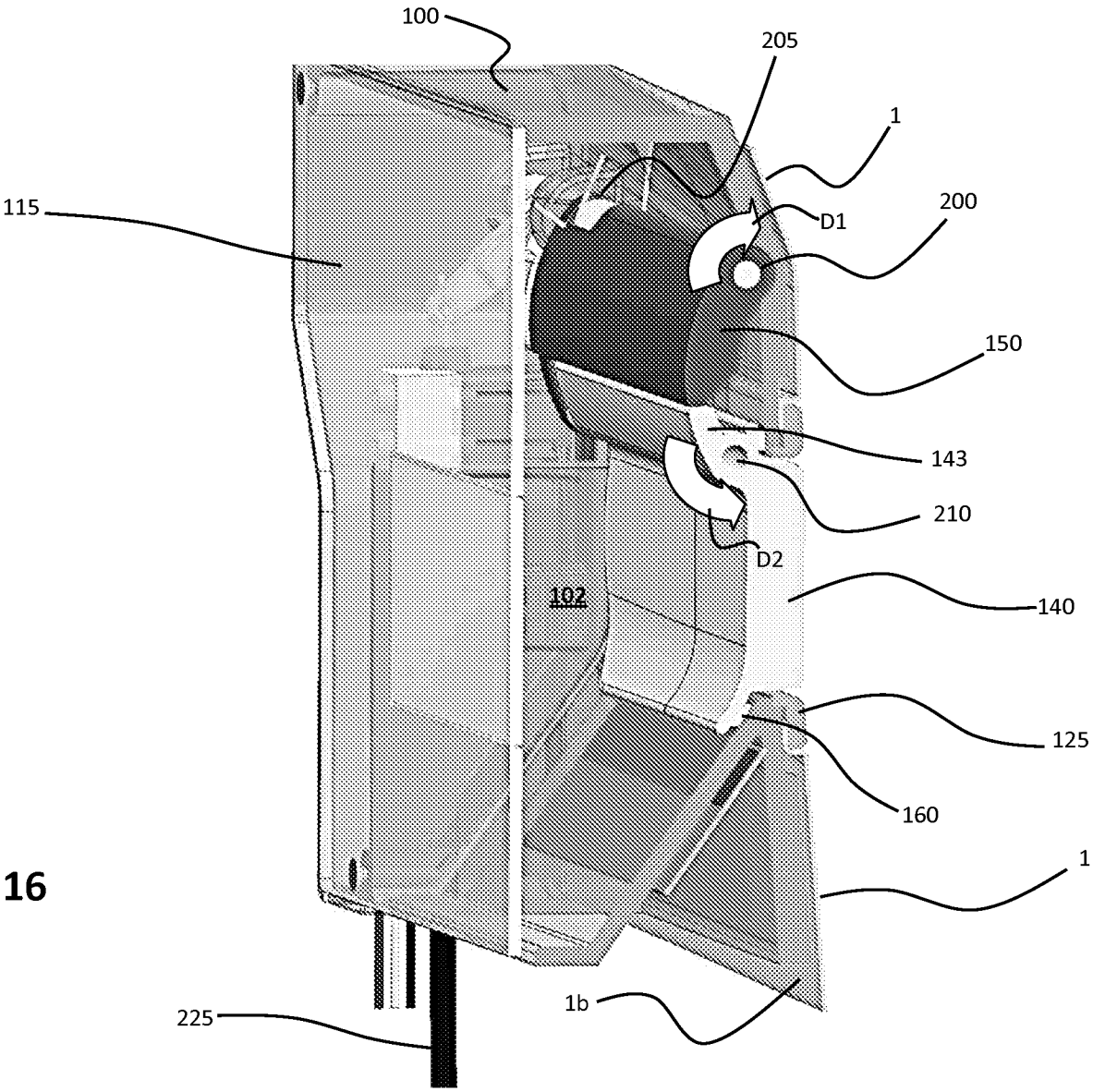
Figure 17:
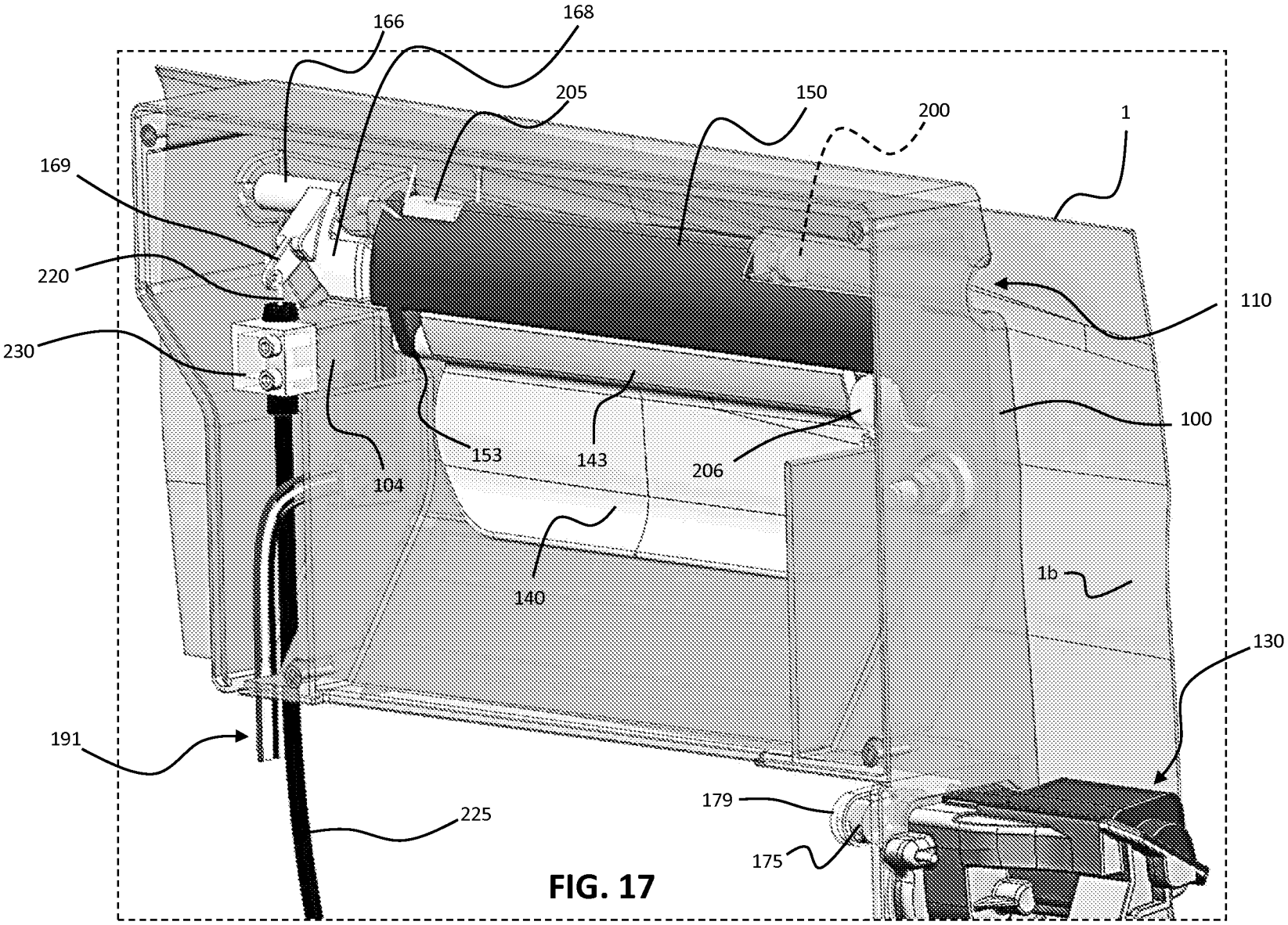
Figure 18:
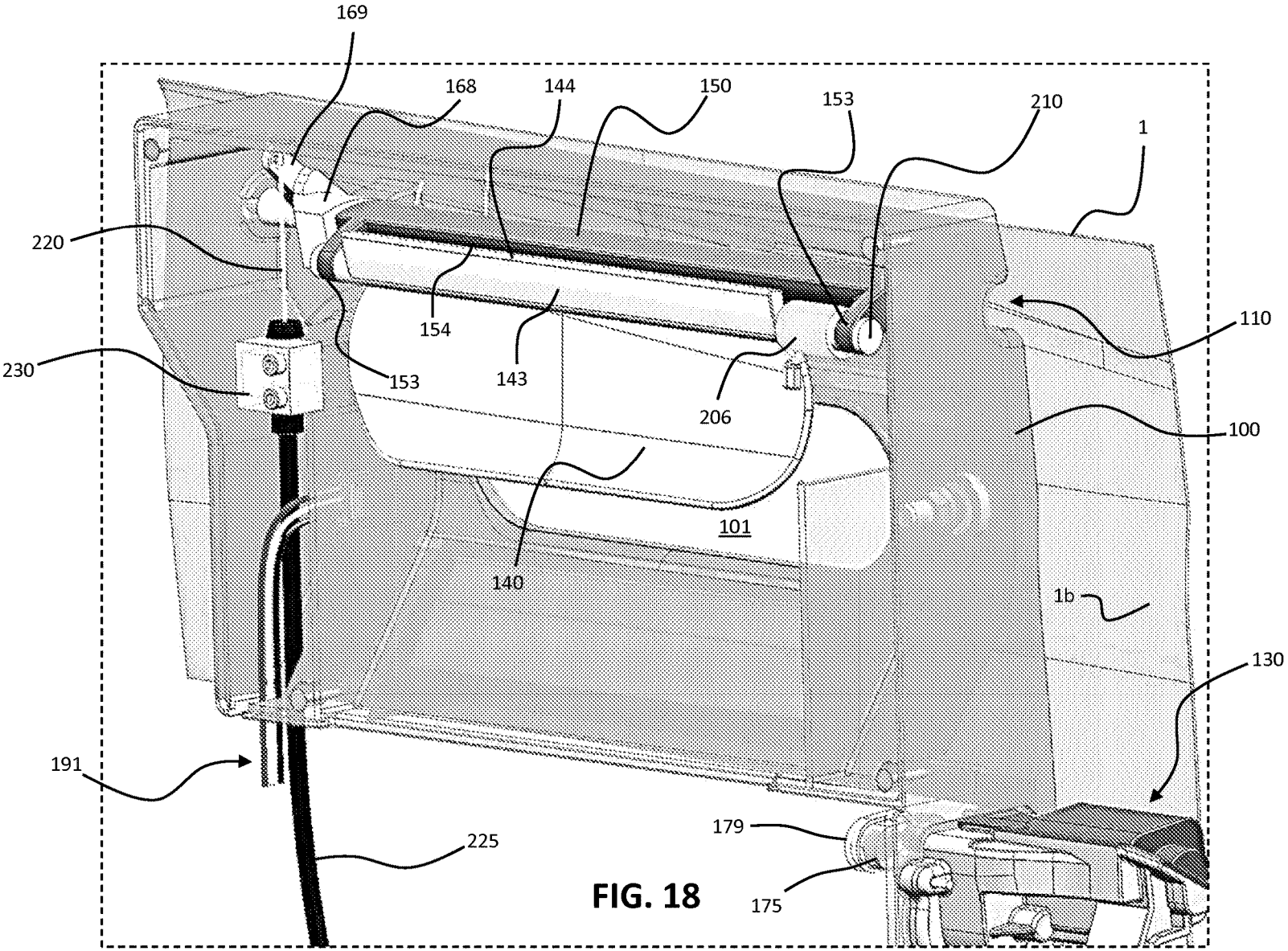

As shown best in FIGS. 13 and 16 an unlatch sensor 195 is positioned on the body 100 proximate the pocket or chamber 102 so as to be actuatable by the hand of a user upon extending into the chamber 102. In conventional manner, sensor 195 is operatively connectable (such as via cables 196) to a latch mechanism (not depicted) for unlatching the vehicle door. Such operative connection may, per convention, be to the vehicle's body control module or other computer or controller (including a local controller associated with the latch mechanism itself) operative to effect mechanical operation of the door latch mechanism. Sensor 195 may be any type of sensor, such as, by way of example and without limitation, a pressure sensor or an infrared sensor; and it will be understood that the disposition of the sensor proximate the chamber 102 will vary according to the type of sensor employed, subject only to the requirement that a user be able to interact with the sensor when his or her hand is at least partially received through the opening 101. As shown in FIG. 13, sensor 195 is, in conventional fashion, secured in potting material 197 so as to be protected from damage.

As shown, the handle assembly is, in substantial part, positioned within the vehicle door proximate the sheet metal defining the exterior door panel 1. More particularly, the body 100 is secured, such as, for instance, by bolts, to the door panel 1 so that the opening 101 is aligned and communicates with the area outside of a motor-vehicle through an opening 2 in the door panel 1. In this manner, the chamber 102 is disposed within the vehicle door and accessible through the openings 2 and 101 when the handle assembly is mounted thereon. Optionally, the handle assembly includes a bezel 125 secured to the exterior surface 1*a* of the door panel 1. Bezel 125 is dimensioned to trim the opening 2 and includes an opening 126 therethrough via which a user's fingers can communicate with the chamber 102. Optionally supported by the bezel 125 in the illustrated embodiment is a lock sensor 190. Per convention, lock sensor 190 is operatively connectable (such as by wiring 191) to the vehicle body control module or other computer or controller which is operative to effect actuation of the vehicle latch mechanism (not depicted) for latching and unlatching/locking and unlocking the vehicle door in conventional fashion when sensor 190 senses a user's presence proximate the bezel 125. Closure 140 is positioned in the opening 101 and selectively moveable between a first, closed position (FIGS. 14, 16, 17, 19), in which the closure 140 closes the opening 101, and a second, opened position (FIGS. 18, 20), in which the closure 140 is moved into the chamber 102 so that the hand of the user may be at least partially received in the opening. Closure 140 is dimensioned to be closely conforming in shape to the opening 101 and the opening 126 in bezel 125, such that the closure 140 in the first, closed position substantially occupies the openings 101 and 126 to prevent receipt of a user's hand therein. As shown best in FIG. 16, closure 140 also has a depth or thickness so that, in the first, closed position thereof, closure extends into and substantially occupies the opening 126 so as to present a generally flush appearance with the bezel 125.

Optionally, a gasket or seal 160 is positioned about the perimeter of the opening 101 or about the perimeter of the closure 140 to seal the closure 140 against the body 100 when the closure 140 is in the first, closed position.

Closure 140 is pivotally connected to a pivot arm 150 which is, in turn, pivotally connected to the body 100. More particularly according to the illustrated embodiment, pivot arm 150 will be seen to comprise an irregularly shaped element, slightly curved along its length to define, in transverse cross-section, somewhat of a lazy "C"-shape. Along one side of its length are provided openings or passageways 151 for receiving pivot arm pins 200, as well as a cut out 152 for mounting a pivot spring 205 on one such pivot arm pin 200. Pivot spring 205 is in the form of a torsion spring the radially extending legs of which contact the body 100 to urge the pivot arm 150 into the position, shown best in FIGS. 16, 17 and 19, it occupies in the first, closed position of the closure 100. Pivot arm pins 200 are also disposed in openings or passageways 110 provided on body 100 (and coaxial with the passageways 151) to thereby pivotally mount pivot arm 200 to body 100.

As best shown in FIGS. 17-20, a door actuator 165 is further mounted on one of the pivot arm pins 200 between body 100 and pivot arm 150. Door actuator 165 includes a first portion 166 defining an opening or passageway for receiving a pivot arm pin 200 therethrough, as well as a second portion 168 which abuts pivot arm 150 and moves it in order to move closure 100 into the second, open position thereof in the manner hereafter described. An arm 169 provided on and extending away from door actuator 165 is connected to an actuation cable 220 to effect movement of the door actuator 165, also in the manner described further below.

At opposite ends of a second side of the length of pivot arm 150 are provided arms or extensions 153 with openings or passageways therethrough for receiving closure pivot pins 210. Closure 140 correspondingly includes along its upper length one or more mounting portions 141 with openings or passageways (coaxial with the openings or passageways of the arms 153) for receiving the closure pivot pins 210. As shown best in FIGS. 17-20, mounting portions 141 are dimensioned to be received between arms 153 of the pivot arm 150. Along a length of mounting portion 141 there is mounted a closure spring 206. Closure spring 206 is in the form of a torsion spring the radially extending legs of which contact each of the closure 140 and the pivot arm 150 to urge the closure 140 toward the opening 101.

As best shown in FIGS. 16-20, a flange 143 extends away from the closure adjacent the one or more mounting portions 141, the flange 143 defining a stop surface 144 which abuts an opposing surface 154 of the pivot arm 150 when the pivot arm and closure 140 are in their relative positions in the first position of the closure 140.

With reference to FIGS. 13, 15, and 17-20 in particular, cable 220 is shown to be a metal cable the principal length of which is disposed in a cable housing 225. At one end, the cable housing 225 is secured to the body 100 proximate door actuator 165, while the corresponding end of the cable 220 is attached to the arm 169 of the door actuator. Securement of the cable housing 225 to the body 100 may be accomplished by any suitable means. In the illustrated embodiment, a mount 104 is formed on body 100 which has a recess in a shape corresponding to a portion of the cable housing 225; a cable holder element 230 with a recess in a shape corresponding to a portion of the cable housing is secured to the mount 104 to capture the cable housing in place.

At the opposite end, cable housing 205 is secured to the motor mount portion 103 of body 100. More particularly, the cable housing is captured between a mount 105 formed on the motor mount portion 103, which mount 105 has a recess in a shape corresponding to a portion of the cable housing 225, and a cable holder element 235 with a recess in a shape corresponding to a portion of the cable housing that is secured to the mount 105. At this opposite end, the corresponding end of the cable 220 is attached to a motor pivot arm assembly 170 comprising a motor pivot arm 171, motor pivot arm adapter 175 and cable cover 179.

Figure 15:
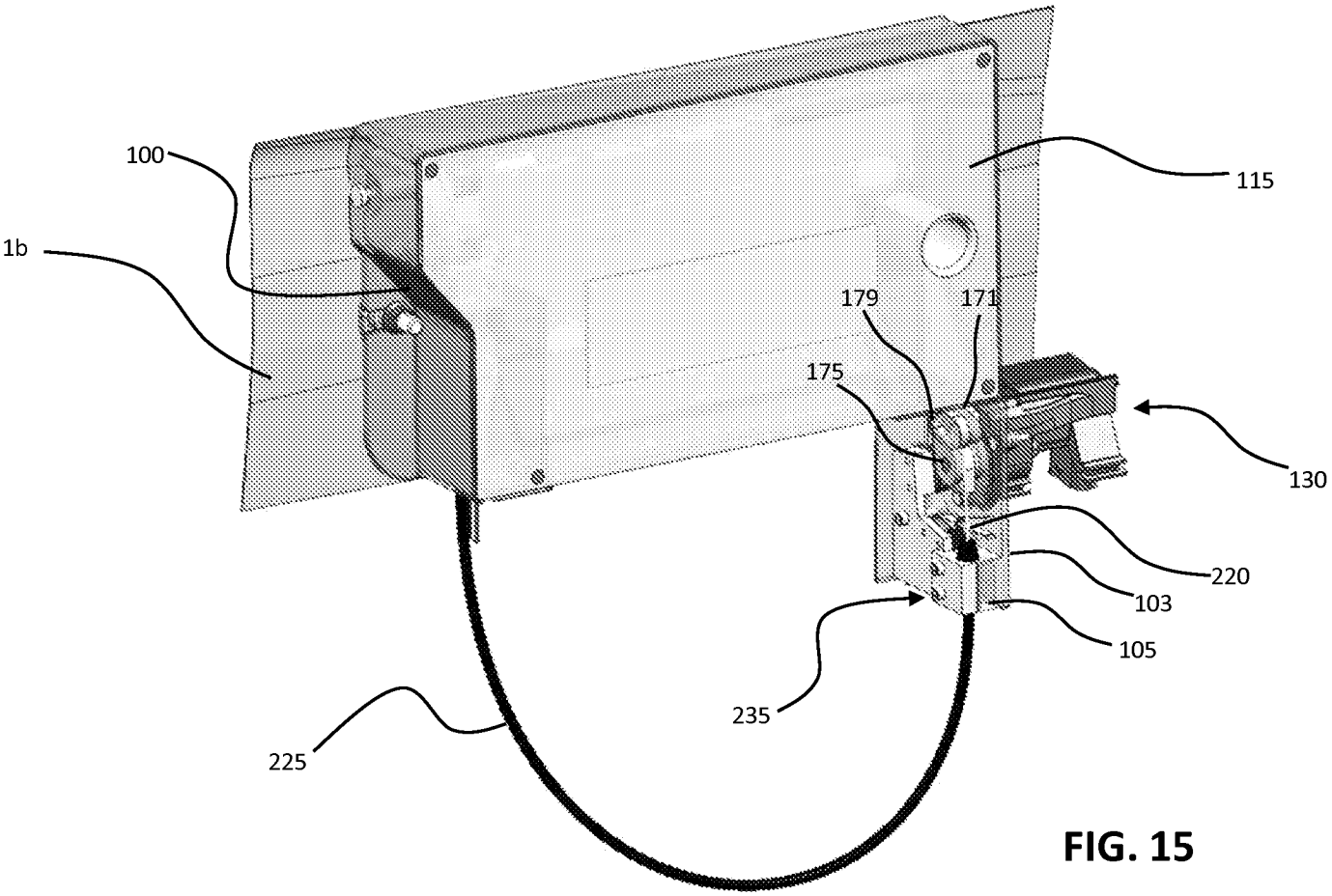
Figure 19:
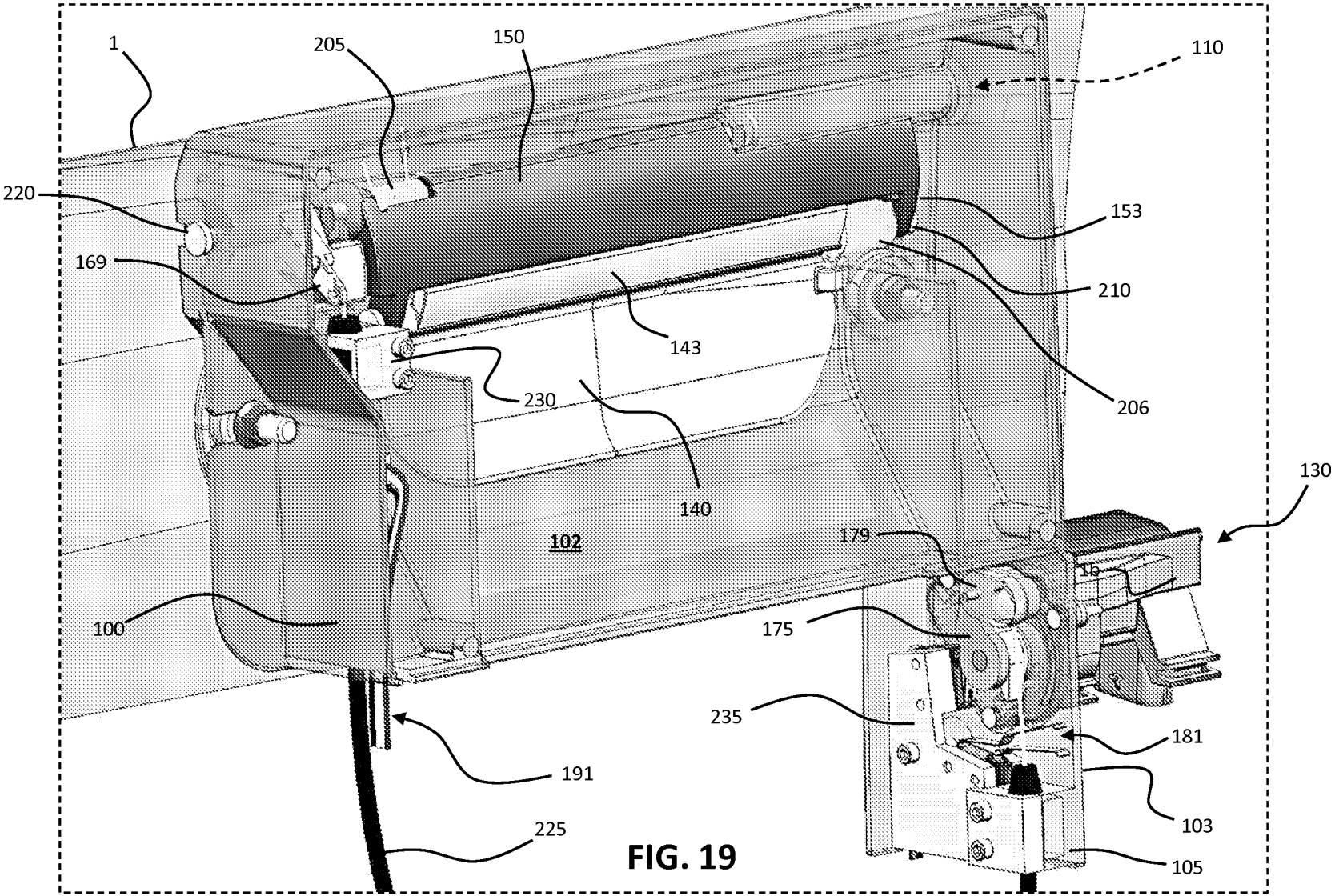
Figure 20:
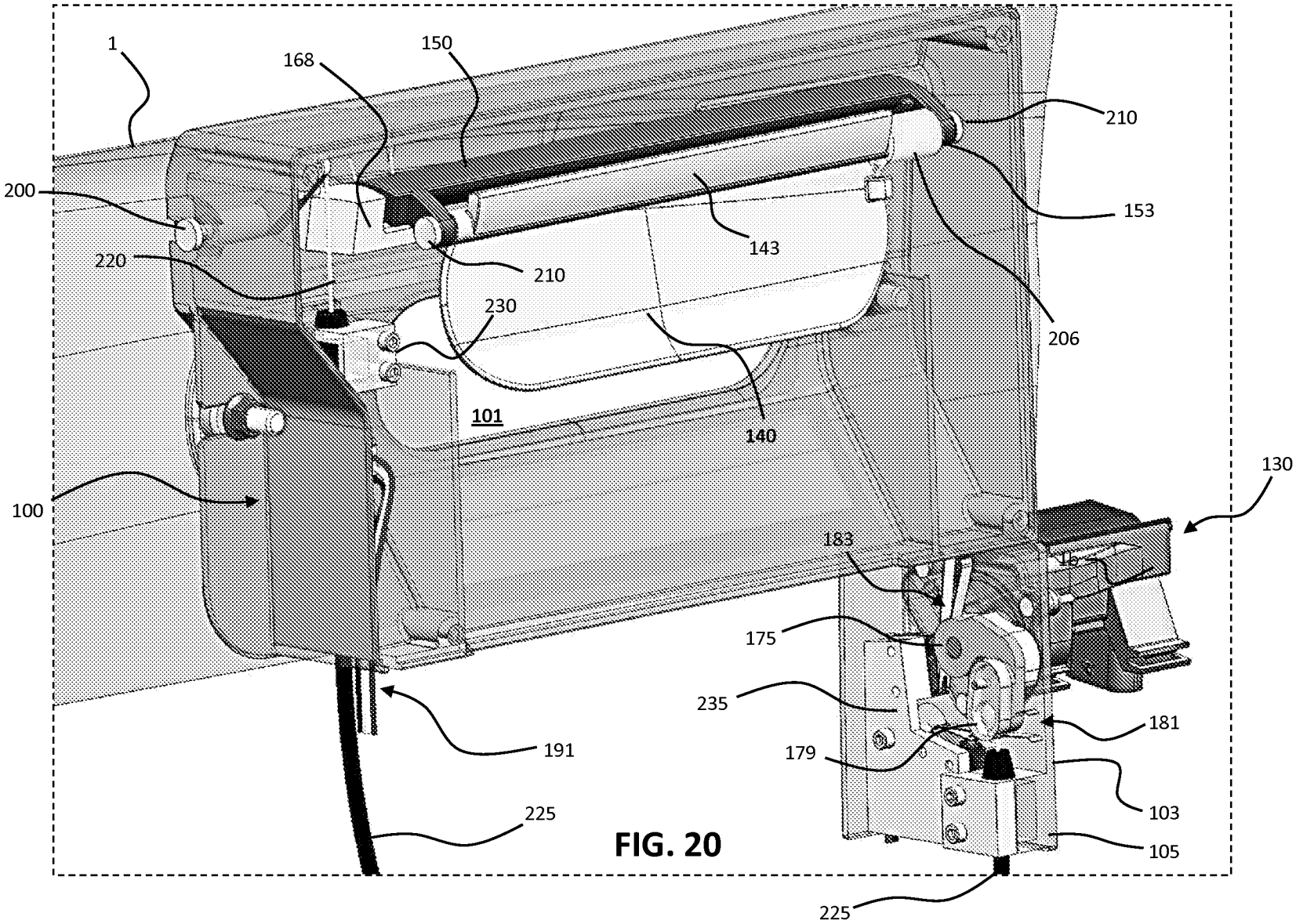

With reference also being had to FIGS. 15, 19 and 20, motor 130 is secured to motor-mount portion 103 so that a rotatable drive shaft (not visible) turned by the motor 103 extends through opening 106 in the motor-mount portion to connect to the motor pivot arm assembly 170. Motor pivot arm assembly 170 is secured to the drive shaft so as to be rotatable therewith.

As with the first embodiment, motor 130 is connectable to a computer or other controller (not depicted) operative to control the selective movement of the closure 140 between the first and second positions thereof, as described further below. Likewise, motor 130 is also connectable to a suitable power source (not depicted), which may be a locally-positioned battery or batteries or another, remotely-disposed power source of the motor vehicle (e.g., the vehicle's main battery).

Motor pivot arm assembly 170 includes a portion which extends away from the axis of the drive shaft, whereby rotation of the motor pivot arm assembly 170 upon rotation of the motor drive shaft in each direction results in the cable 220 being either pushed or pulled relative to the cable housing 225. More particularly, and with reference being had to FIGS. 17-20, it will be seen that the disposition of the cable 220 is such that, in movement of closure 140 from the first, closed position (FIGS. 17, 19) to the second, opened position (FIGS. 18, 20), operation of the motor 130 and corresponding movement of motor pivot arm assembly 170 pushes the cable within the cable housing 225 so that the cable urges rotational movement of the door actuator 165 about the pivot arm pin 200. This motion, in turn, carries with it the pivot arm 150 which is contacted by the door actuator arm 169. And, as pivot arm 150 rotates about pivot arm pins 200 in a first direction D1, it carries with it the closure 140, which is urged by the closure spring 206 to rotate about closure pivot pins 210 move relative to the pivot arm 150 in a second direction D2 which is opposite the first direction. On the other hand, the disposition of the cable 220 is such that, in movement of closure 140 from the second, opened position (FIGS. 18, 20) to the first, closed position (FIGS. 17, 19), operation of the motor 130 and corresponding movement of motor pivot arm assembly 170 in the opposite direction pulls the cable 220 within the cable housing 225 so that the cable likewise pulls the door actuator 165. This motion, in turn, allows the pivot arm 150 to be urged by the action of the pivot arm spring 205 in the opposite direction (i.e., the direction D2), thereby returning the closure 140 to the first, closed position thereof.

By the foregoing description, it will be appreciated that, according to the illustrated embodiment, motor 130 selectively effects movement of the closure 140 between the first and second positions thereof even though, according to the exemplary embodiment, the motor 130 doesn't actually drive the closure 140 back to the first position from the second position thereof. That is, operation of the motor 130 is necessary to move the closure 140 back to its first position (which movement is accomplished through the biasing action of the springs 205, 206), as the position occupied by the door actuator arm 169 in the second position of the closure 140 would otherwise prevent movement of the closure back to the first position thereof.

With reference particularly being had to FIGS. 13, 19 and 20, there will be seen to be provided, proximate pivot arm assembly 170, limit switches 181, 183, each of which is operatively connected (such as via wiring 182, 184) to the motor controller (not shown) and, as necessary, a source of power (not shown). In the illustrated embodiment, limit switch 181 is positioned so as to be actuated by the motor pivot arm assembly 170 when closure 140 is in the second, opened position thereof, while the limit switch 183 is positioned to be actuated by the motor pivot arm assembly 170 when closure 140 is in the first, closed position thereof.

As with the first embodiment of the invention, the motor controller (whether the vehicle's body control module or other computer or controller) is programmed to reset the motor 130 when each limit switch 181, 183 is actuated, such that the motor will thereafter rotate in the opposite direction upon its next activation. In other words, actuation of the limit switch 181 results in the motor 130 being reset so that the drive shaft thereof rotates in next actuation of the motor in the direction which permits movement of closure 140 back to the first position thereof. Conversely, actuation of the limit switch 183 results in the motor 130 being reset so that the drive shaft thereof rotates in next actuation of the motor in the direction which moves closure 140 to the second, opened position thereof.

Optionally, motor 130 is effectively locked at the end of each cycle, such that, in the first position of the closure especially, the closure may not be forced open to permit access to the sensor. Alternatively, and particularly where the sensor is programmed to be operative only in circumstances where the vehicle's on-board computer (such as the body control module) or other controller or computer detects the authorized signal of the vehicle's "key fob" remote control, it may be desirable that the closure can be forced to its second position in the event a vehicle power failure prevents powered operation of the motor 130.

In use, the handle assembly of the present invention is installed in a motor vehicle including at least one door by which a user can enter and exit the vehicle. Per convention, the at least one door is characterized by a locked state, in which the door cannot be opened by the user, and an unlocked state, in which the door can be unlatched and opened by the user via a handle assembly disposed on the at least one door.

Likewise, to effect operation of the motor, a controller, such as, for instance, the motor vehicle's body control module or other computer or controller (including, for instance, a local controller), is operatively connected to the motor 130 to control the selective movement of the closure 140 between the first and second positions thereof. The controller is programmed to be responsive to signals (whether passively or actively generated) from a remote control, such as a conventional "key fob" remote, and/or from detection of a user (such as via user contact with the sensor 190) to effect selective movement of the closure 140 between the first, closed, to the second, opened positions thereof.

Still more particularly, in the illustrated embodiment the computer or controller operatively connected to the motor 130 is: (a) responsive to an unlock signal from the remote control to move the closure from the first to the second position thereof; (b) responsive to a lock signal from the remote control to move the closure from the second to the first position thereof; and/or (c) responsive to the an authorized user's (established, for instance, by passive detection of the authorized "key fob" remote) interaction with the sensor 190 to move the closure from the first to the second position thereof and/or from the second position to the first position thereof.

When the closure 140 is in the second, opened position, access to the chamber 102 via the openings 101, 2 and 126 is possible. Upon extending his or her hand at least partially into the pocket or chamber 102, the user's fingers are detected by the sensor 195, which effects actuation of the door latch mechanism as heretofore described to allow the user to open the vehicle door.

Though not depicted in FIGS. 13-20, it will be understood that the handle assembly of the second embodiment may be provided with at least one light-transmissive portion positioned proximate the opening of the body, along with one or more light sources operative to selectively illuminate the at least one light-transmissive portion when the closure is in at least one of the first or second positions thereof, all in the manner exemplified in connection with the first embodiment set out above. Furthermore, it will be understood that the operation of the one or more light sources may likewise be effected essentially as hereinabove described.

It will be appreciated from the foregoing disclosure that the second embodiment of the invention advantageously permits the closure to have a height that is greater than the depth of the pocket or chamber 102 since the dual pivot mechanism as exemplified above pivotally moves the closure 140 relative in a direction which is opposite the direction of movement of the pivot arm when the closure moves from the closed to the opened position thereof. In this manner, as will be appreciated from the disclosure, the closure remains more or less vertically orientated.

Although various embodiments of the present invention have been described and illustrated, it will be apparent to those skilled in the art that numerous modifications and variations can be made without departing from the scope of the invention, which is defined in the appended claims.

The invention in which an exclusive property or privilege is claimed is defined as follows:

1. A handle assembly for a vehicle door, comprising:

a body defining an opening dimensioned to at least partially receive therein a hand of a user, the opening communicating with a chamber defined in the body anterior of the opening;

at least one pivot arm pivotally mounted on to the body for pivotal movement of the at least one pivot arm relative to the body;

a closure for the opening, the closure pivotally connected directly to the at least one pivot arm for pivotal movement of the closure relative to the at least one pivot arm, the closure selectively moveable via pivotal movement of the at least one pivot arm relative to the body between a first position, in which the closure occupies the opening, and a second position, in which the closure is moved into the chamber so that the hand of the user may be at least partially received through the opening; and a motor operatively coupled to the at least one pivot arm for pivotally moving the at least one pivot arm relative to the body to effect-selective movement of the closure between the first and second positions thereof;

wherein, in movement from the first position to the second position of the closure, the at least one pivot arm pivotally moves relative to the body in a first direction and the closure pivotally moves relative to the at least one pivot arm in a second direction which is opposite the first direction.

2. The handle assembly of claim 1, further comprising a sensor actuatable by the hand of the user, the sensor operatively connectable to a latch mechanism for latching and unlatching a vehicle door.

3. The handle assembly claim 1, further comprising:

at least one light-transmissive portion positioned proximate the opening of the body; and one or more light sources operative to selectively illuminate the at least one light-transmissive portion in a first color of light in response to one or more signals from a remote control and the closure being in the first position thereof, and to selectively illuminate the at least one light-transmissive portion in a second, different color of light in response to the one or more signals from the remote control and the closure being in the second position thereof.

4. The handle assembly of claim 3, wherein the one or more light sources are operative to selectively illuminate the at least one light-transmissive portion in any of two or more colors of light.

5. The handle assembly of claim 3, wherein the at least one light-transmissive portion comprises a light-transmissive portion positioned about the entire perimeter of the opening.

6. The handle assembly of claim 3, further comprising a sensor actuatable by the hand of the user, the sensor operatively connectable to a latch mechanism for latching and unlatching a vehicle door.

* * * * *